US009228794B2

(12) United States Patent
Tusting

(10) Patent No.: US 9,228,794 B2
(45) Date of Patent: Jan. 5, 2016

(54) EXTENDABLE TANG FOR A FIREARM

(71) Applicant: Paul A. Tusting, Salt Lake City, UT (US)

(72) Inventor: Paul A. Tusting, Salt Lake City, UT (US)

( * ) Notice: Subject to any disclaimer, the term of this patent is extended or adjusted under 35 U.S.C. 154(b) by 0 days.

(21) Appl. No.: 14/329,618

(22) Filed: Jul. 11, 2014

(65) Prior Publication Data

US 2015/0047244 A1 Feb. 19, 2015

Related U.S. Application Data

(63) Continuation-in-part of application No. 13/968,179, filed on Aug. 15, 2013, now Pat. No. 8,844,184.

(51) Int. Cl.

| | |
|---|---|
| ***F41C 23/10*** | (2006.01) |
| ***F41C 3/14*** | (2006.01) |
| ***F41C 23/04*** | (2006.01) |
| *F41C 33/04* | (2006.01) |

(52) U.S. Cl.
CPC . *F41C 23/10* (2013.01); *F41C 3/14* (2013.01); *F41C 23/04* (2013.01); *F41C 33/048* (2013.01)

(58) Field of Classification Search
CPC ..... F41C 23/10; F41C 23/16; F41C 33/048
USPC ..... 42/71.02, 72, 71.01, 94; 89/1.42
See application file for complete search history.

(56) References Cited

U.S. PATENT DOCUMENTS

| | | | | |
|---|---|---|---|---|
| 5,029,407 | A * | 7/1991 | Kirkpatrick | 42/94 |
| 7,111,424 | B1 * | 9/2006 | Moody et al. | 42/72 |
| 7,954,271 | B1 * | 6/2011 | Bentley et al. | 42/71.01 |
| 8,156,676 | B1 * | 4/2012 | Moody | 42/71.01 |
| 2011/0247256 | A1 * | 10/2011 | Lickteig | 42/94 |
| 2014/0338245 | A1 * | 11/2014 | Lanasa et al. | 42/72 |

* cited by examiner

*Primary Examiner* — Reginald Tillman, Jr.
(74) *Attorney, Agent, or Firm* — Geoffrey E. Dobbin; Dobbin IP Law P.C.

(57) ABSTRACT

Extendable tangs are used to increase the surface area of grips so as to better enable users with larger hands to adequately control smaller items. Tangs are stowed within the body of a grip and deployed through one of a number of mechanisms, including spring-loaded and non-spring loaded mechanisms.

11 Claims, 28 Drawing Sheets

EXTENDABLE TANG FOR A FIREARM

CROSS-REFERENCES TO RELATED APPLICATIONS

This application claims priority as a continuation-in-part of prior filed U.S. Non-provisional application Ser. No. 13/968,179 filed Aug. 15, 2013 which in turn claims priority on prior filed U.S. Provisional application No. 61/691,229, filed Aug. 20, 2012 and incorporates both of these applications herein by reference in their entirety.

FIELD OF THE INVENTION

The present invention relates to the field of firearms and more particularly relates to an extendable grip tang for use with a firearms, with particular use with a concealable spring-actuated revolver.

BACKGROUND OF THE INVENTION

Personal defense is a matter of choice for individuals. Some choose to not have any, others prefer training in martial arts, some choose a weapon. Often times, that weapon is a firearm such as a small handgun, so the use of a firearm for personal defense is well known. Users of firearms tend to conceal them in their clothing or other objects. Law enforcement and military personnel often conceal them on their persons as a "back-up" weapon, in case their primary weapon fails or situations become dire. As such, the ideal back-up weapon is ideally small and easily concealable. Their positioning is not to hinder the movement of the carrier. They tend to carry a few rounds of ammunition and maybe have some container or magazine to carry spare rounds. They tend not to be very accurate at a distance.

The present invention is a an extendable grip tang with many different embodiments, all being suitable for reducing the stowage profile of a firearm, such as one of the many types suitable for a back-up weapon. The tang may or may not be spring-loaded and may be actuated by use of a pressure plate or by the cocking of the hammer or may be keyed such that removal from a holster deploys the tang or any other means known in the art or later discovered may be used to deploy the tang.

SUMMARY OF THE INVENTION

In view of the foregoing disadvantages inherent in the known types of firearms, this invention provides an extendable grip tang for many types of firearms, including the concealable spring-loaded revolver of the parent application. As such, the present invention's general purpose is to provide a new and improved tang which allows the firearm to be more compact and concealable, is easily constructed, and safe when in a concealable configuration.

To accomplish these objectives, the tang comprises a tang body concealable in an orifice within the grip of the firearm. Embodiments of the extendable tang may be either spring operated or pressure operated by the natural positioning of the user's hand. Embodiments for both revolvers and magazine fed handguns are shown, though the invention may be practiced on any type of firearm, or other device, with a suitable grip.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
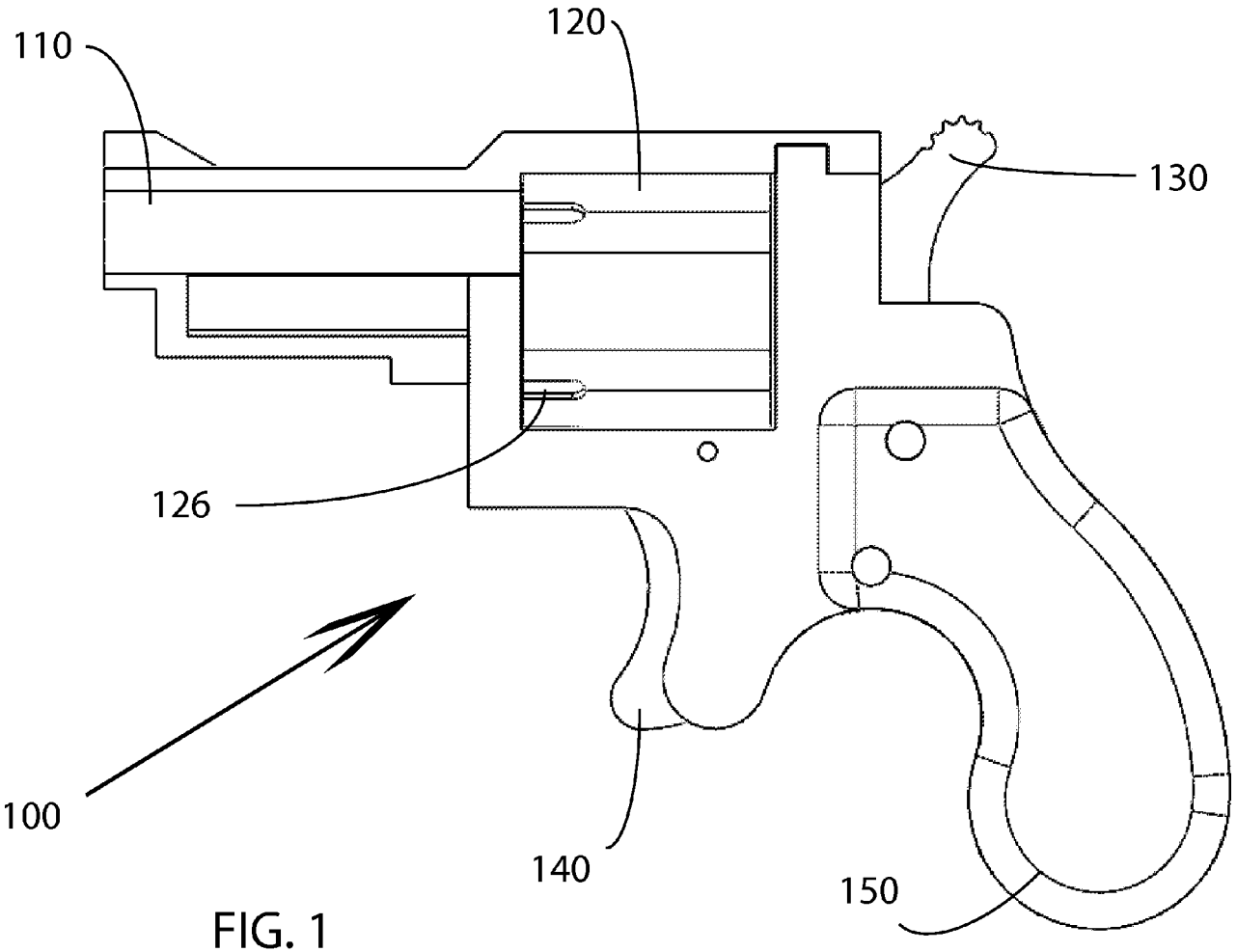
FIG. 1 is a side elevation of one embodiment of a revolver according to the present invention.

With reference now to the drawings, the preferred embodiment and alternate embodiments of the grip extension tang are herein described. It should be noted that the articles "a", "an", and "the", as used in this specification, include plural referents unless the content clearly dictates otherwise. It should also be realized that while the figures depict handguns, the invention may be practiced on any firearm or other object with a suitable grip, such as an AR-15 rifle with a "pistol grip" attachment. The use of handguns in the drawings and use of terminology in this Specification related to handguns should not be deemed limiting the invention to practice with handguns alone.

A basic revolver with which the invention may be used is illustrated in FIGS. 1-7. With reference to FIG. 1, a revolver 100 has the main components expected of a revolver, that is to say it has a barrel 110, cylinder 120, hammer 130, trigger 140 and grip 150 all mounted upon a frame or receiver. Its internal workings, however, shown in FIGS. 2-5, however, reveal a different sort of weapon. First, the cylinder 120 is powered by a torsion-type cylinder spring 112 mounted beneath the barrel 110. A pivoting locking bar 114 maintains the cylinder 120 against the spring pressure. The forward end of the locking bar 114 is a locking bar key 116 designed to interface with specifically positioned lock grooves 126, 128 on a forward end of the cylinder 120. The end of the locking bar opposite the key features a locking bar plate 134 which interfaces with a hammer pawl 132 pivotably mounted upon the hammer 130.

Figure 2:
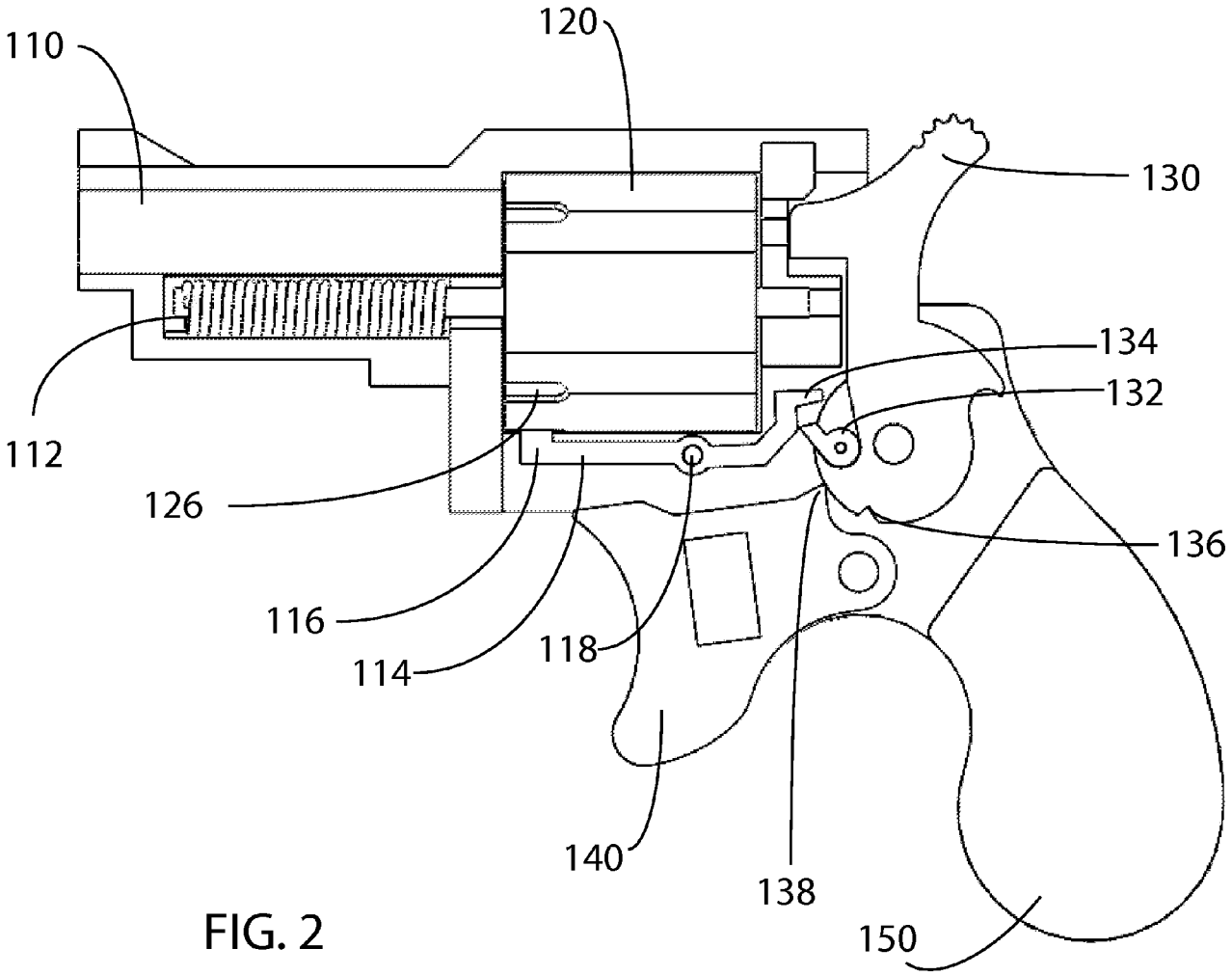
FIG. 2 is a sectional view of the revolver of FIG. 1 in a stowed orientation.
Figure 3:
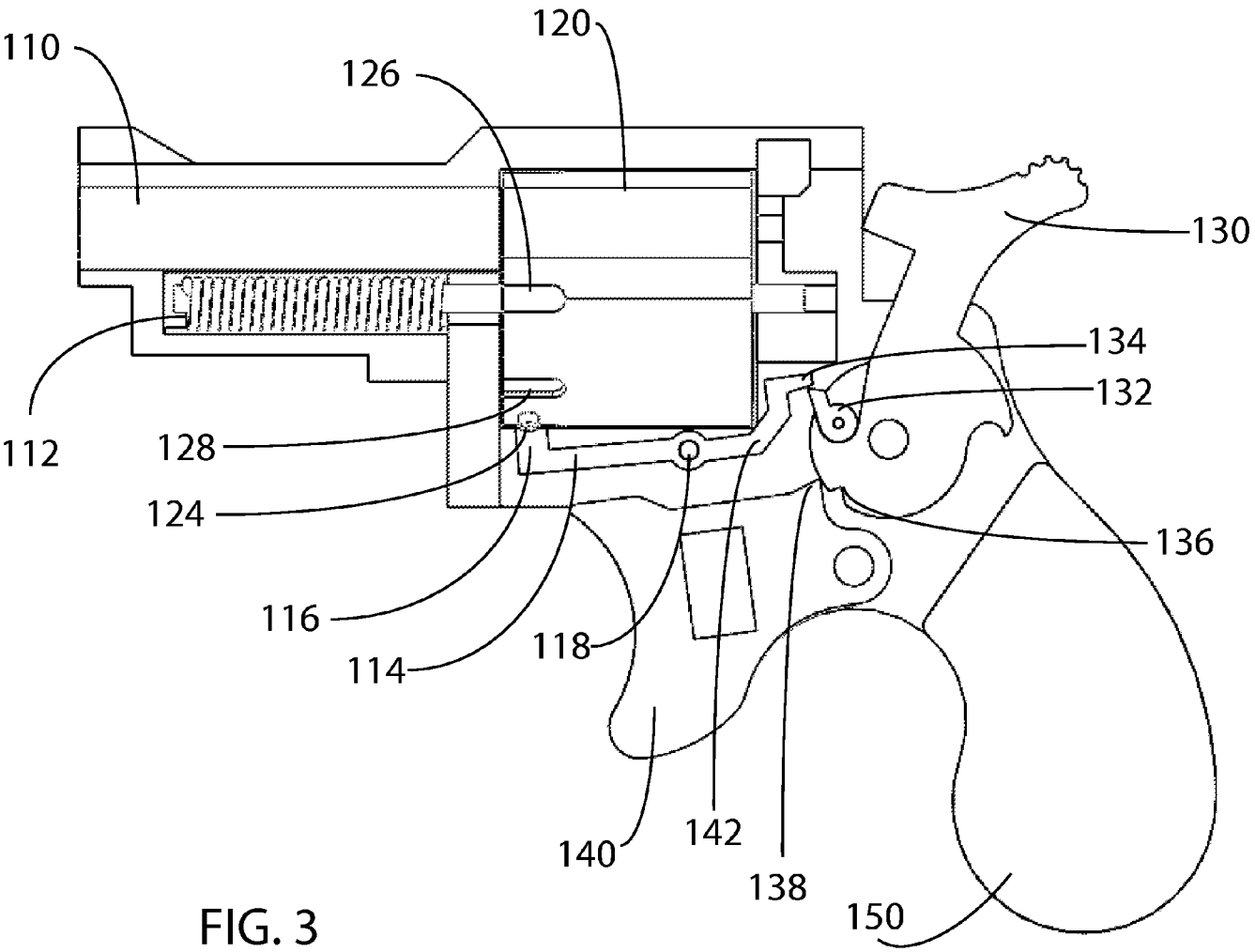
FIG. 3 is a sectional view of the revolver of FIG. 1, in the process of cocking.
Figure 4:
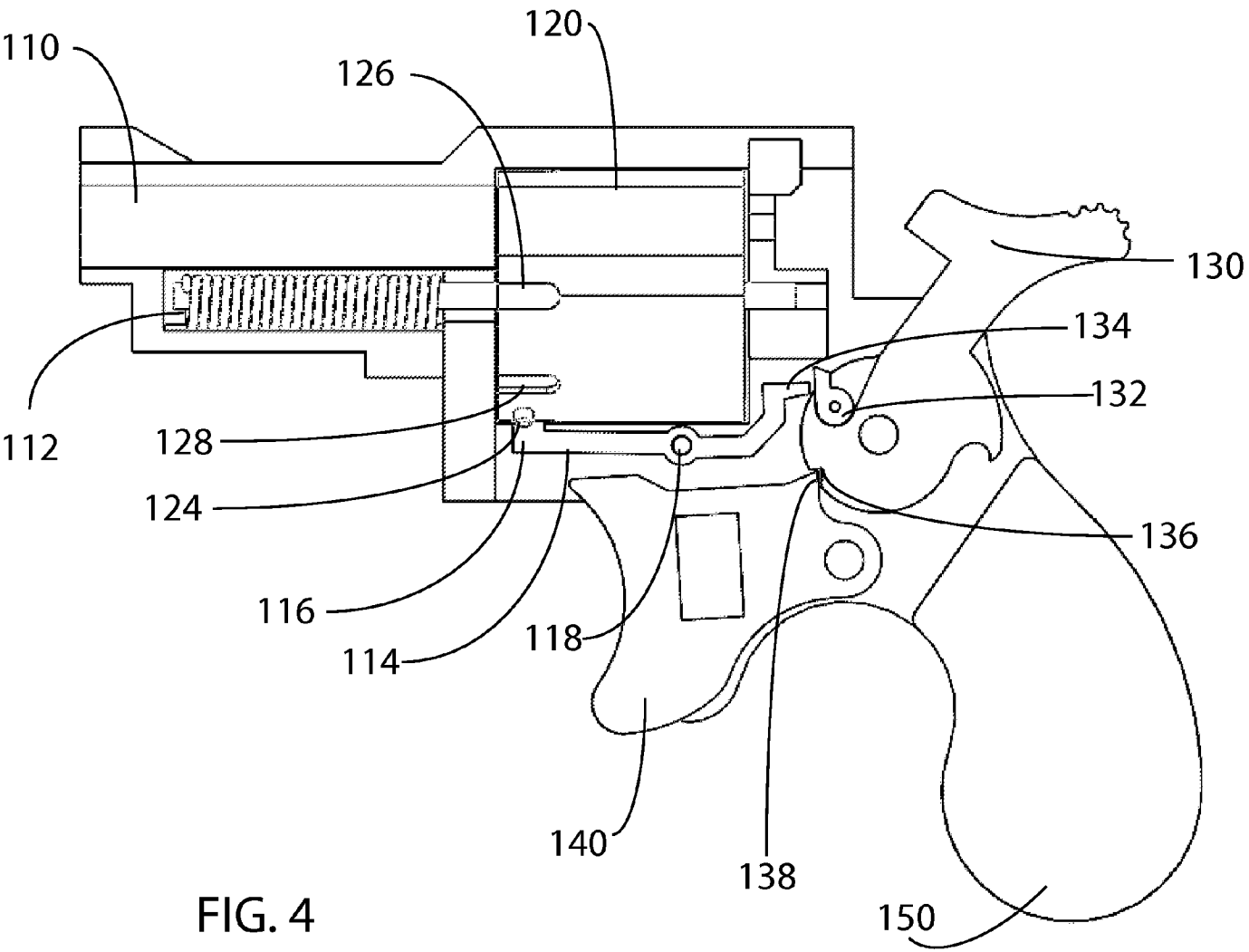
FIG. 4 is a sectional view of the revolver of FIG. 1, fully cocked.
Figure 5:
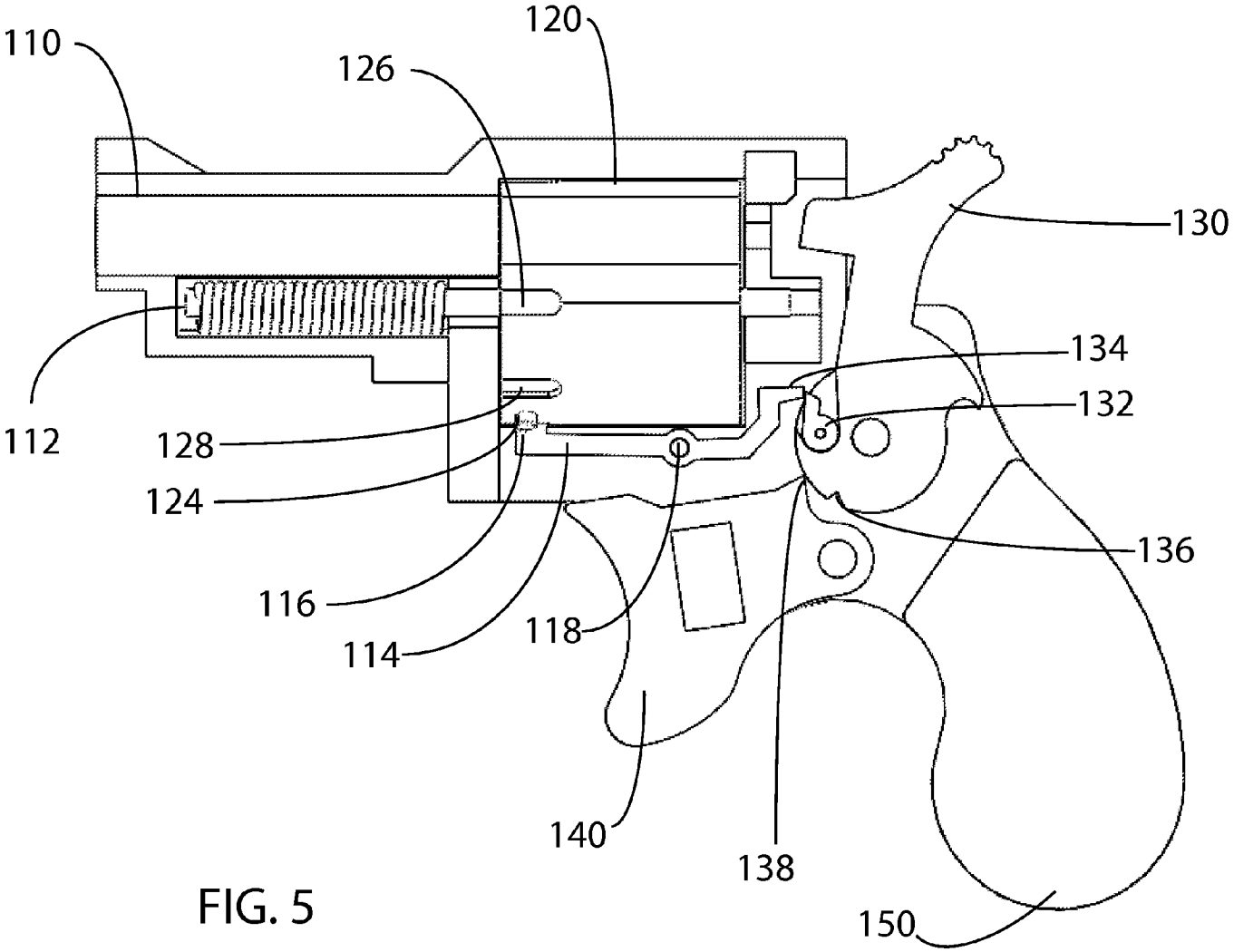
FIG. 5 is a sectional view of the revolver of FIG. 1, firing.

When stowed, FIG. 2, the cylinder rests in a unique position off-chamber from the bore of the barrel 110 (and consequently the hammer 130). It is held in this position by the locking bar key 116 residing in a specially positioned safety lock groove 128 (shown in FIG. 3). In subsequent use, the action of cocking the hammer 130 drives the hammer pawl 132 against the locking bar plate 134, pushing it upwards. The locking bar 114 pivots about its pivot point 118 and forces the locking bar key 116 downward, releasing the cylinder 120. Immediate over-rotation of the cylinder is prevented by a chamfer 142 in the locking bar 114. The chamfer 142 stops rotation of the cylinder 120 by blocking one of its corners. Other structures may of course be utilized, including having other structure on the cylinder interface with the chamfer 142 or other movable blocking structure; however, this embodiment is preferred. In the fully cocked position (FIG. 4), the hammer pawl 132 has passed beyond the locking bar plate 134, releasing it and thereby forcing the locking bar key 116 to move upwards into the next successive position lock groove 126. In this position, the revolver is ready to fire with a chamber 122 in line with the barrel 110 and hammer 130. An interface with the trigger 140 holds the hammer 130 in cocked position. The illustrated mechanism is a simple spur-and-groove lock where a sear-spur 138 on the trigger 140 interfaces with a groove 136 on the hammer 130. Other structures of sears may of course be used. Upon firing (FIG. 5), the sear lock is broken and the hammer 130 begins to return. The pawl 132 rotates against the locking bar plate 134 and into a crevice in the hammer 130 until the pawl 132 is moved away from the locking bar plate 134 and returns to its position underneath the locking bar plate 134.

Figure 7:
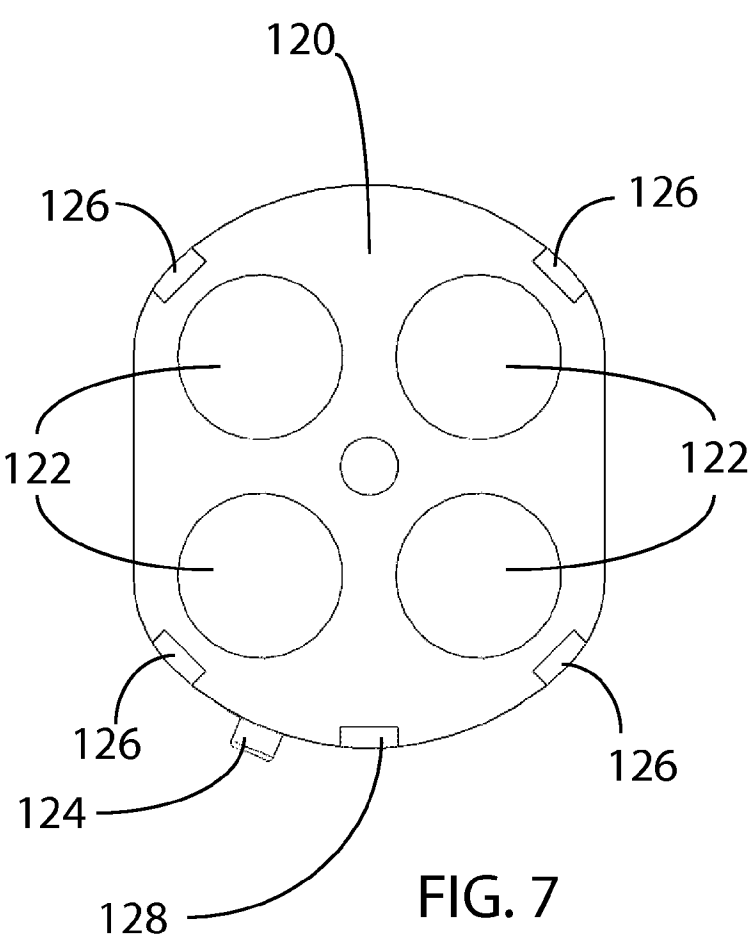
FIG. 7 is a front elevation of the cylinder of the revolver of FIG. 1.
Figure 6:
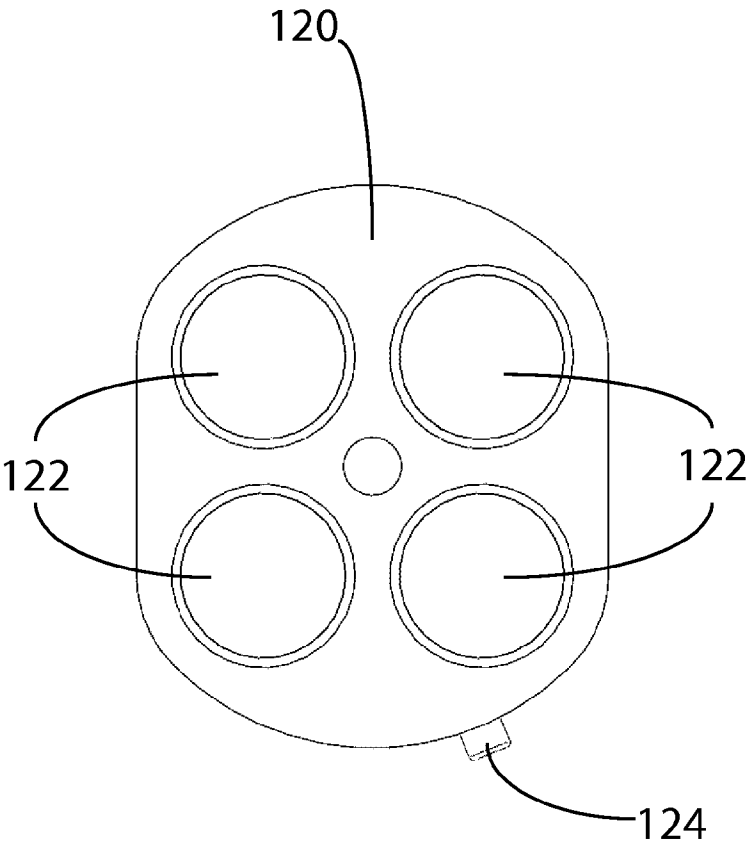
FIG. 6 is a rear elevation of the cylinder of the revolver of FIG. 1.

The cylinder 120 provides a slim profile to aid in concealment. As can be seen in FIGS. 6 and 7, the cylinder is uniquely shaped. There are limited lines of symmetry with the design of the cylinder and the outside surface of the cylinder proximate each chamber is not consistent relative to the axis of rotation of the cylinder.

Figure 8:
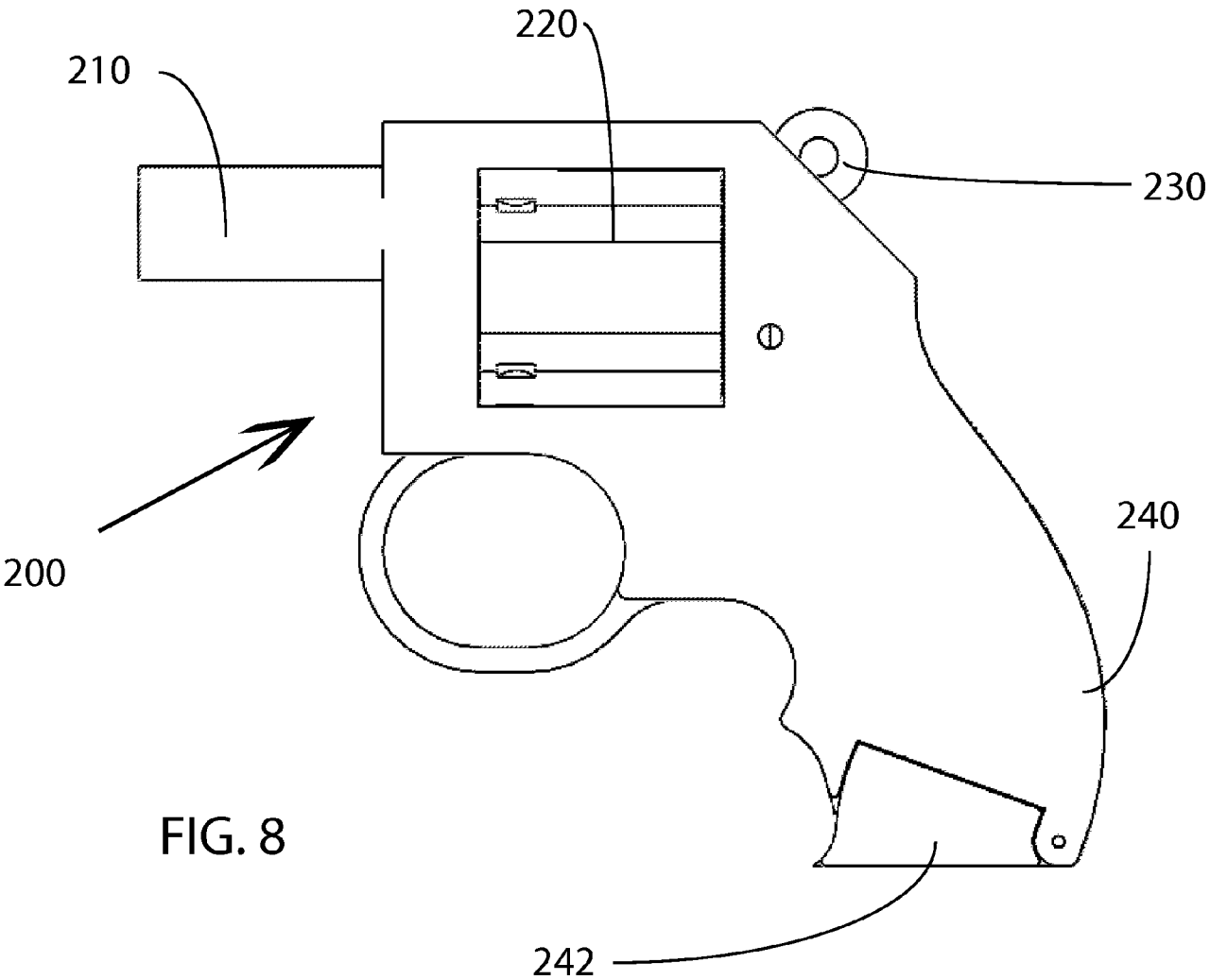
FIG. 8 is a sectional view of a second embodiment of a revolver with which the present invention may be utilized.
Figure 9:
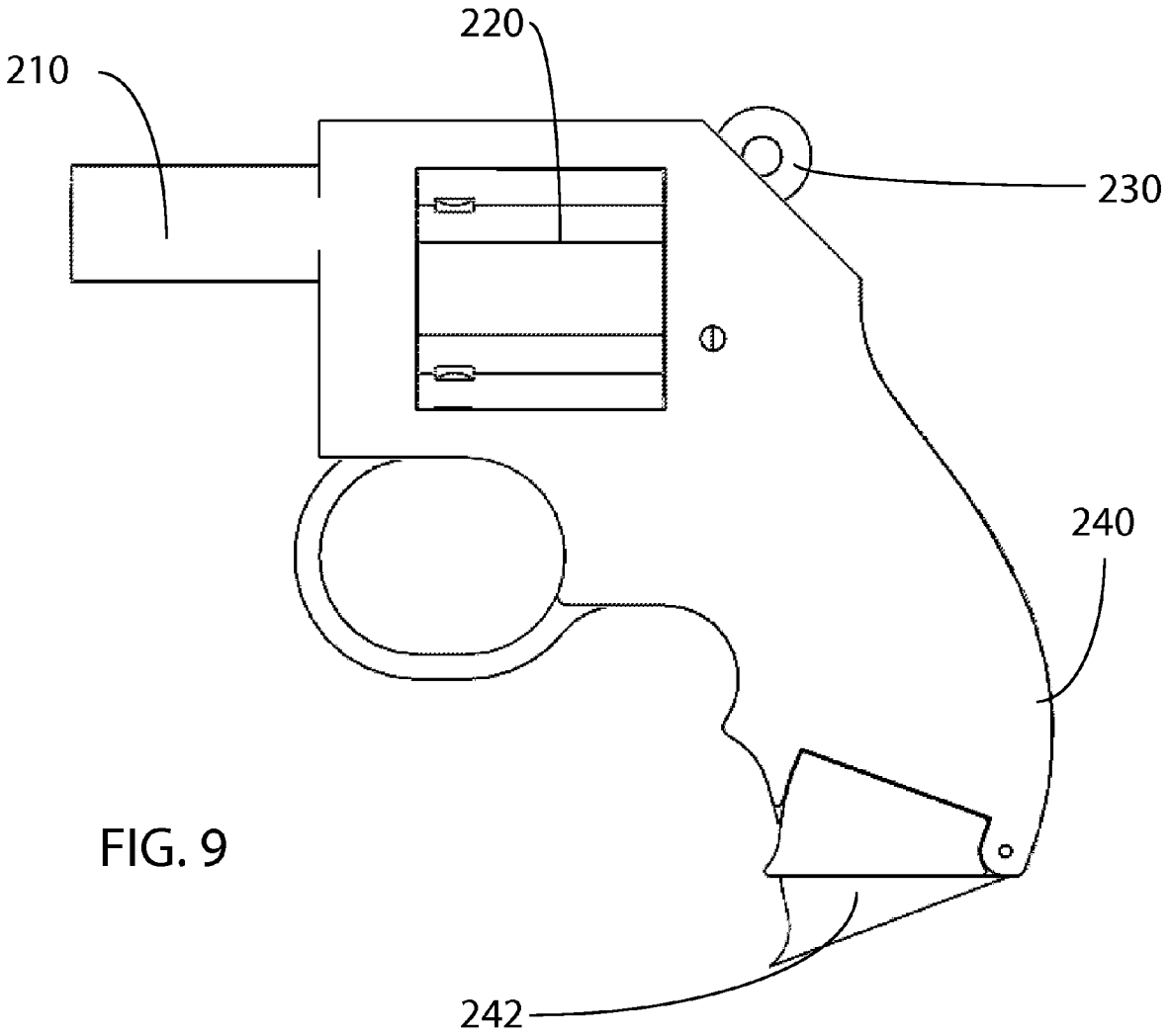
FIG. 9 is a sectional view of the revolver of FIG. 8, with a deployed grip extension tang.
Figure 10:
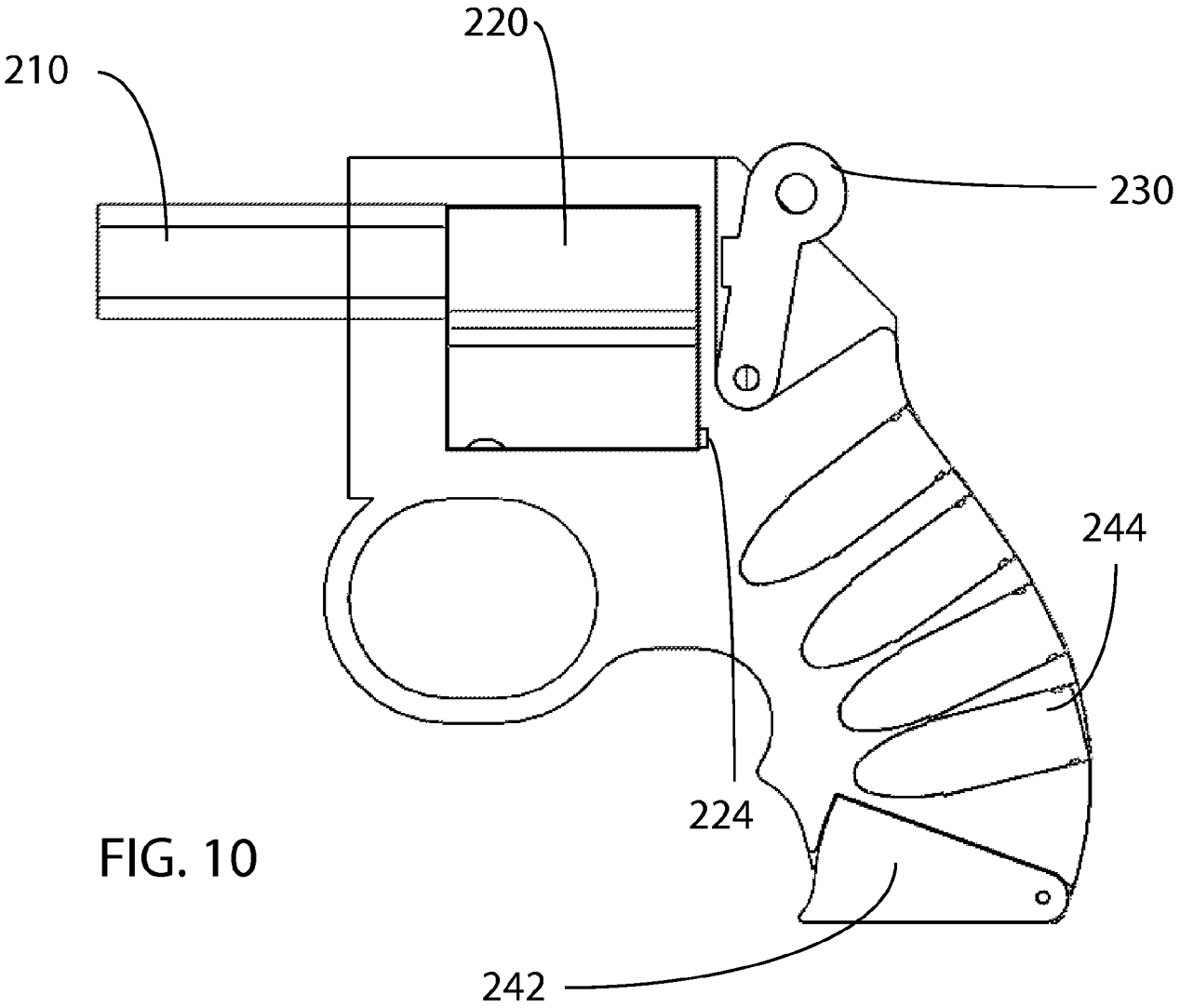
FIG. 10 is a sectional view of the an alternate revolver embodiment, with a stowed extension tang.
Figure 11:
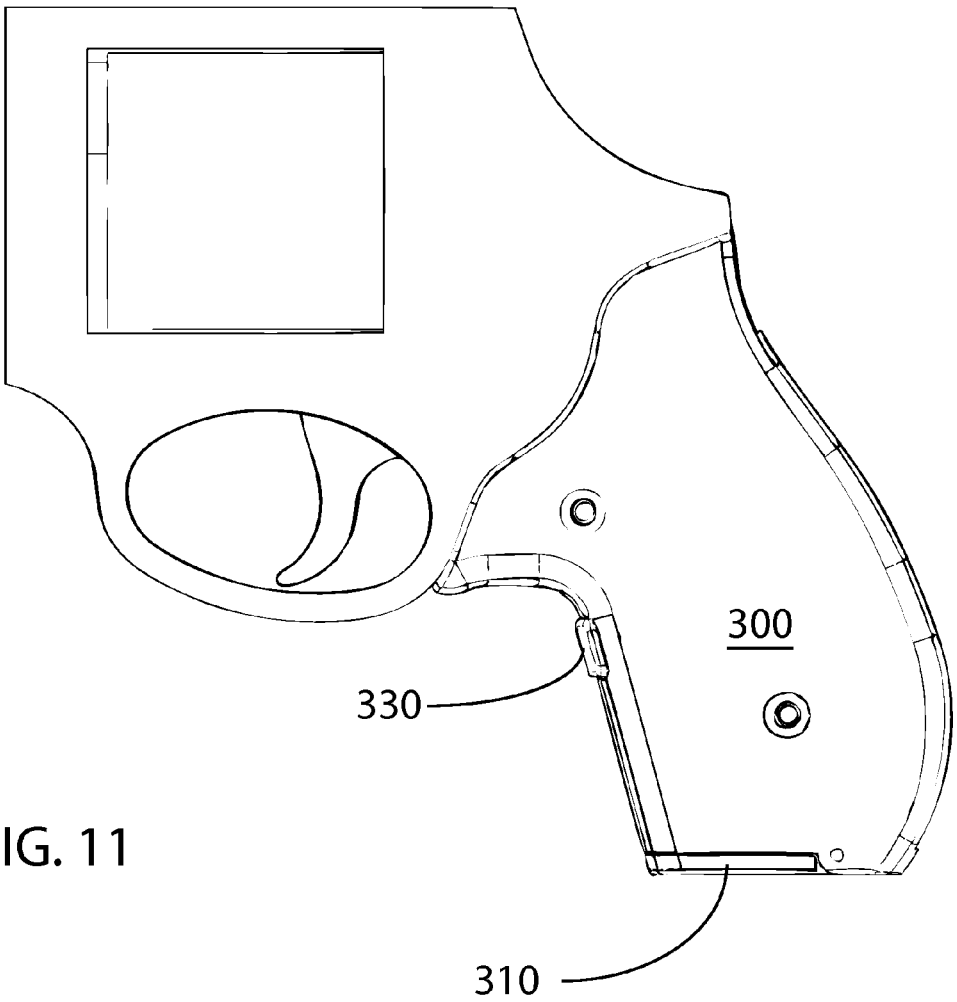
FIG. 11 is a side elevation of a handgun utilizing one embodiment of the present invention with the extension tang stowed.
Figure 12:
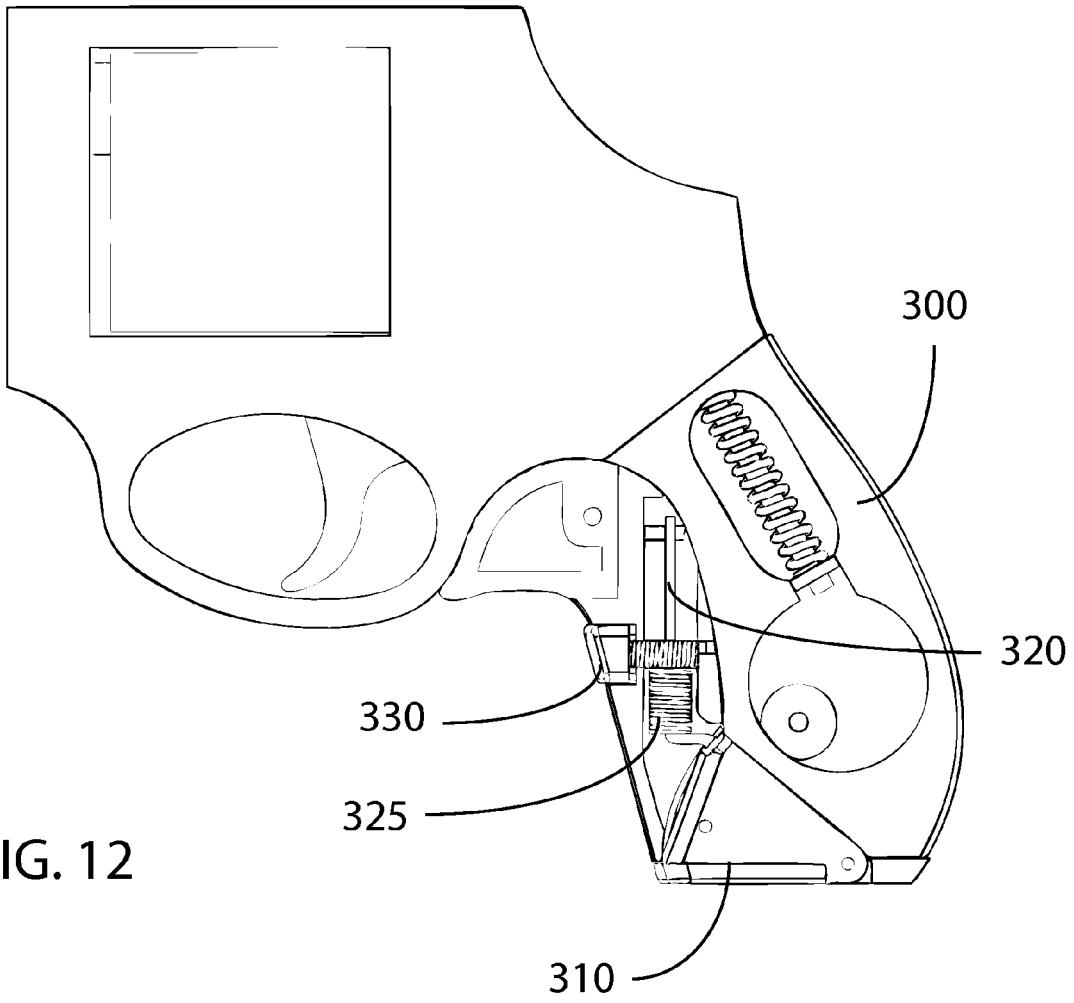
FIG. 12 is the handgun of FIG. 11, with one grip panel removed.
Figure 13:
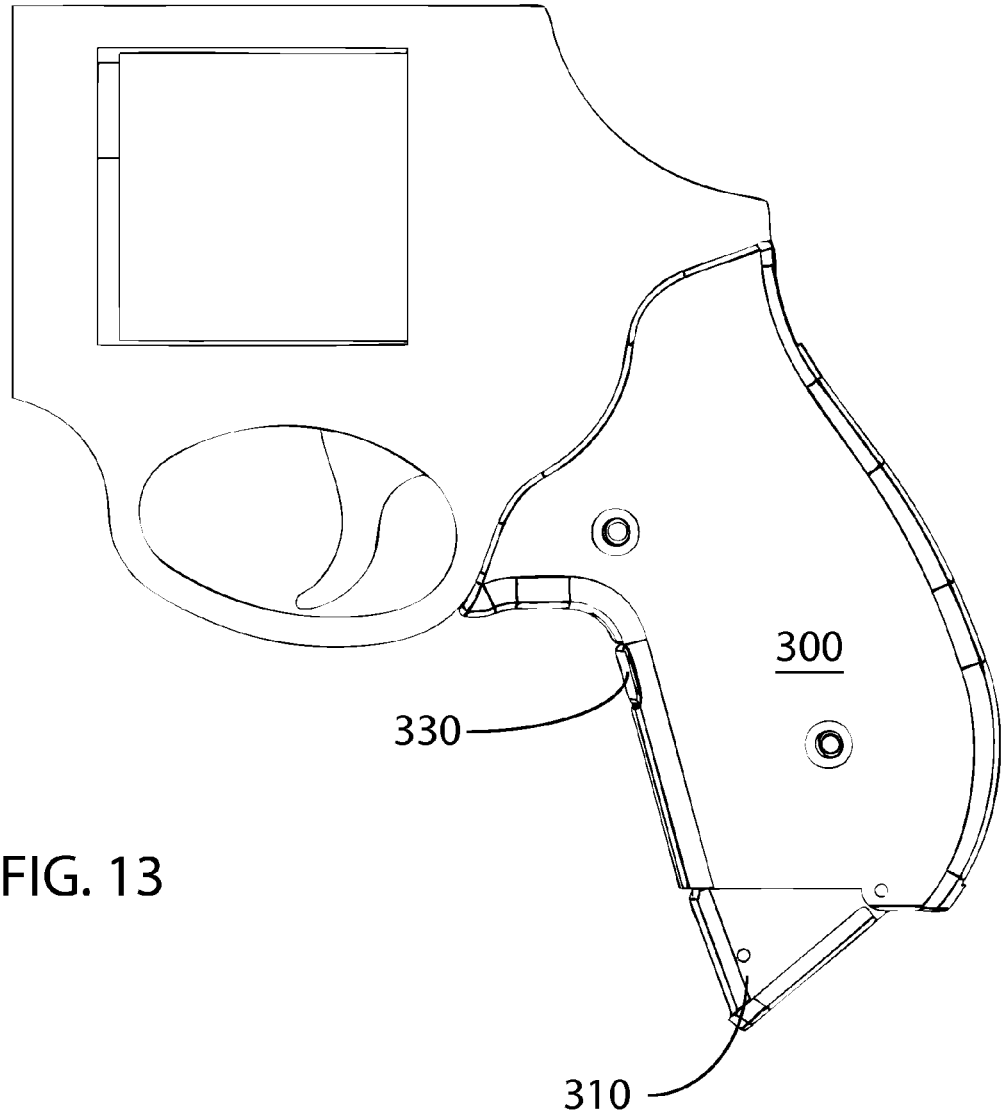
FIG. 13 is the handgun of FIG. 11, with the extension tang deployed.
Figure 14:
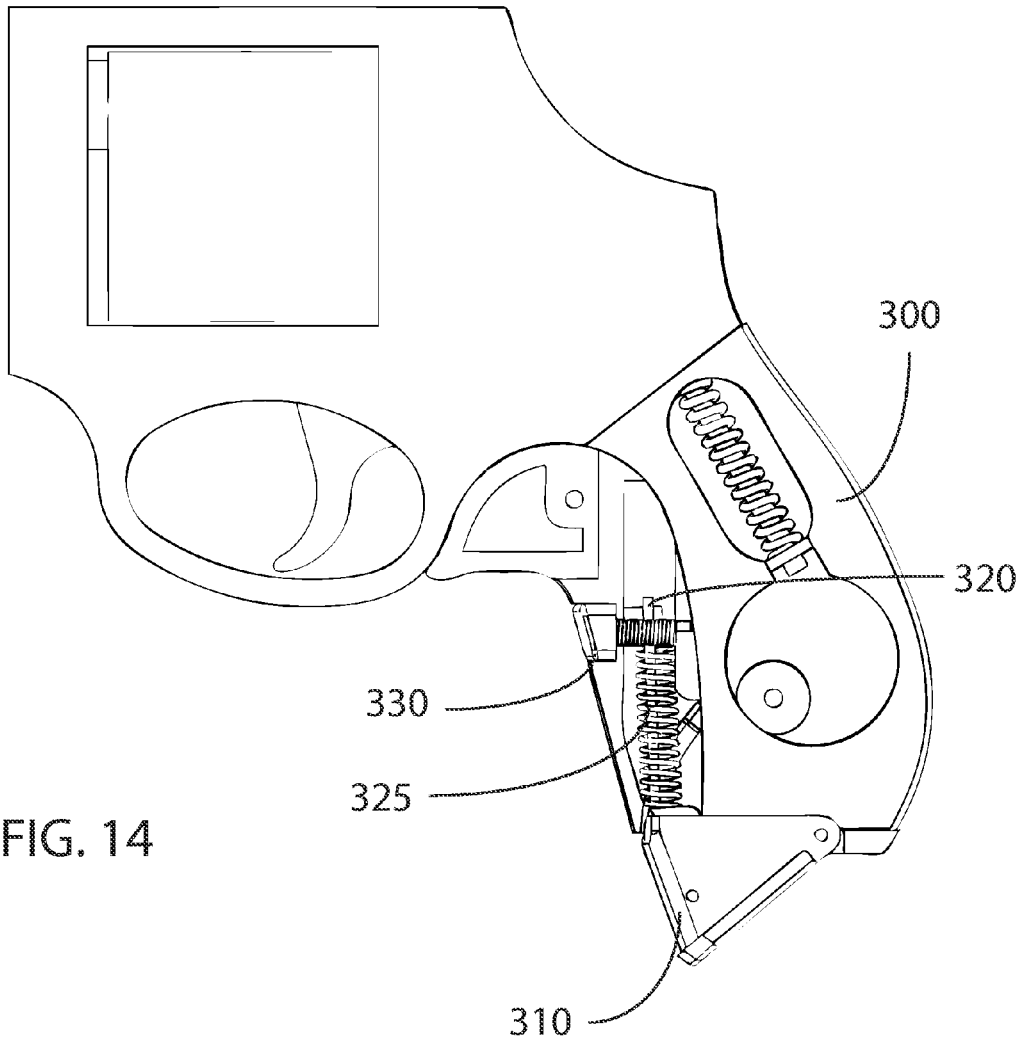
FIG. 14 is the handgun of FIG. 13, with one grip panel removed.

Another revolver 200 is shown in FIGS. 8-10, where a specialized grip is used to provide a still smaller stowed profile. A grip extension tang 242 is provided in the bottom of grip 240 that may be deployed into an extended position and thus provide a larger gripping surface (FIG. 9). The tang 242 may be spring-loaded and actuated by use of a pressure plate or may be actuated by the cocking of the hammer or may be keyed to removal from a holster or any other means known in the art or later discovered. The tang 242 may also not be spring-loaded and may pivot or slide into position due to direct pressure on some part of the grip.

Figure 15:
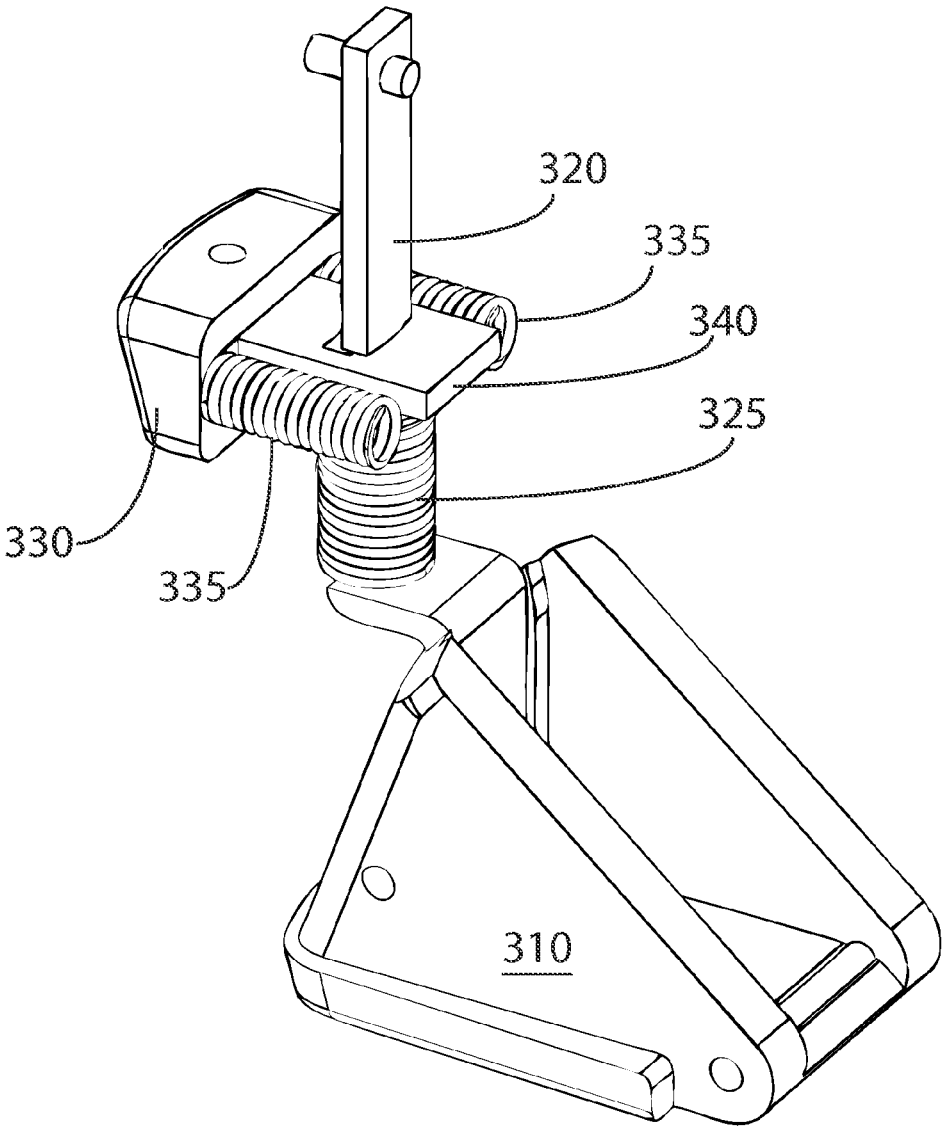
FIG. 15 is a perspective view of the mechanism utilized in the handgun of FIG. 11, in a stowed orientation.
Figure 16:
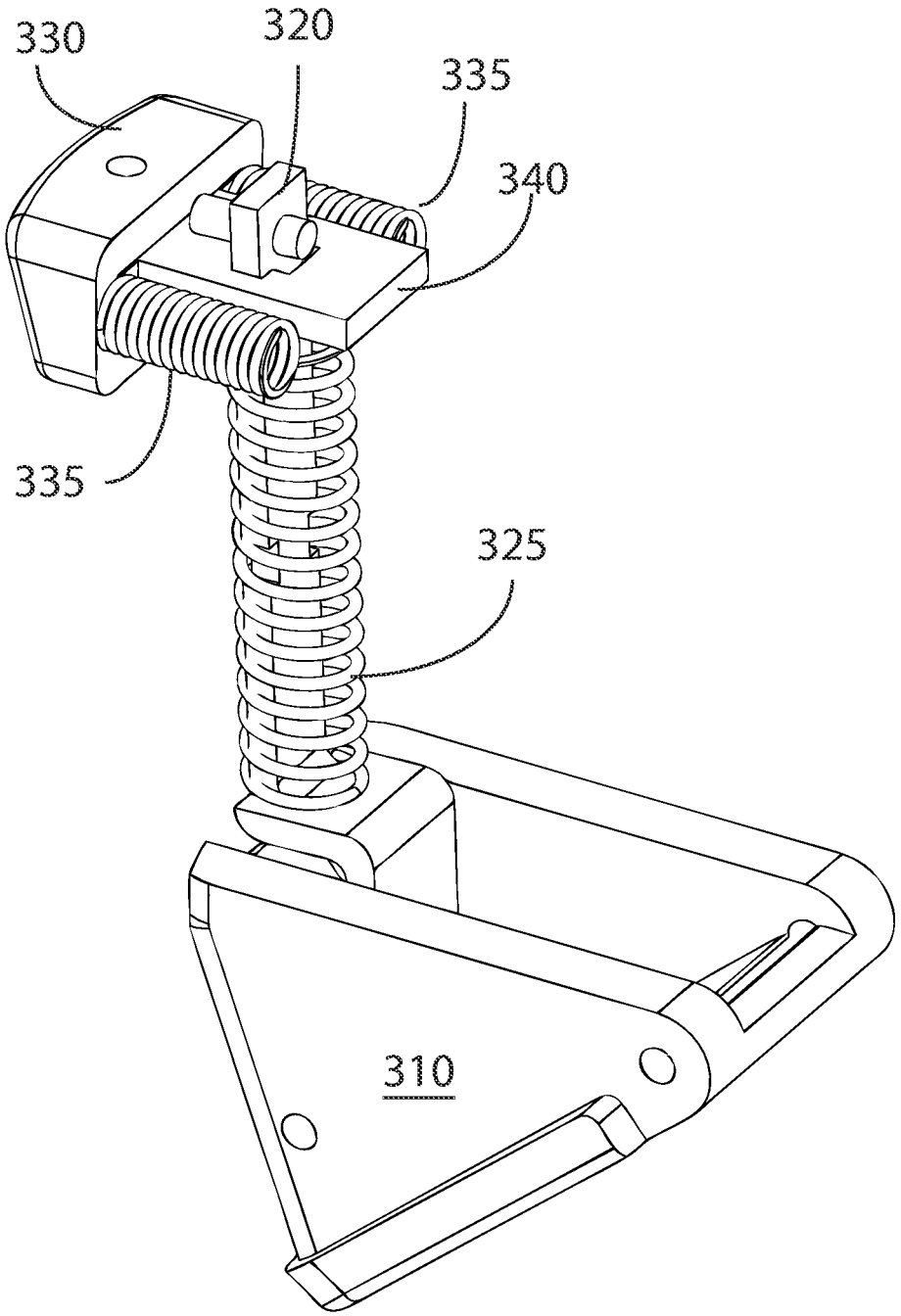
FIG. 16 is a perspective view of the mechanism utilized in the handgun of FIG. 11, in a deployed orientation.
Figure 17:
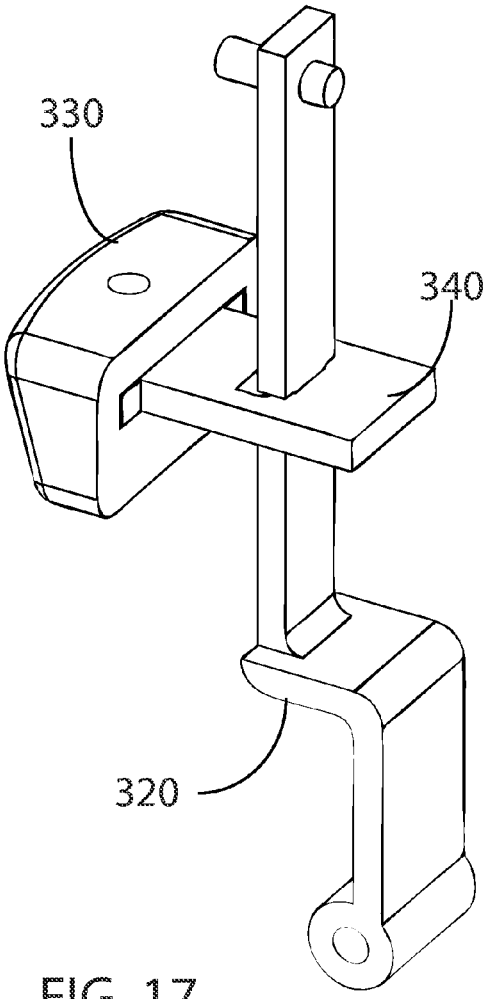
FIG. 17 is a perspective view of the linkage components of the mechanism used in the handgun of FIG. 11, in a stowed orientation.
Figure 18:
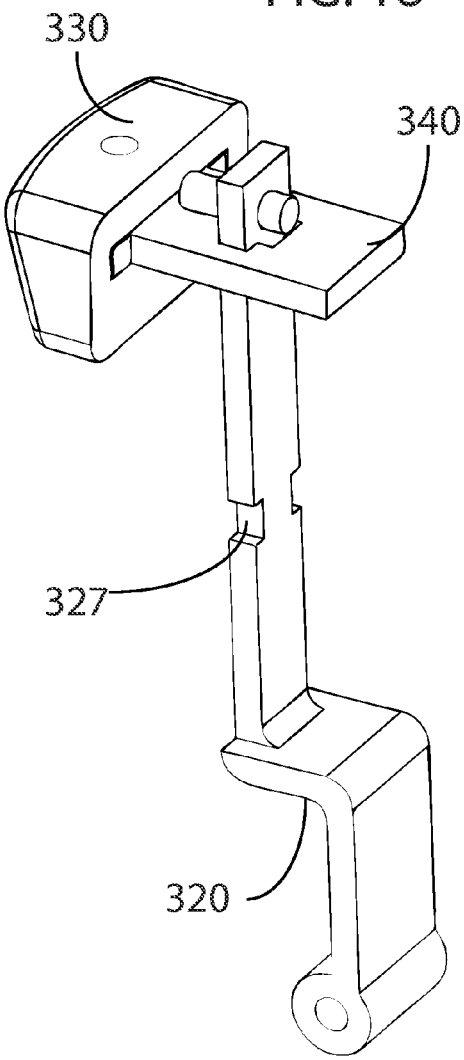
FIG. 18 is a perspective view of the linkage components of the mechanism used in the handgun of FIG. 11, in a deployed orientation.
Figure 19:
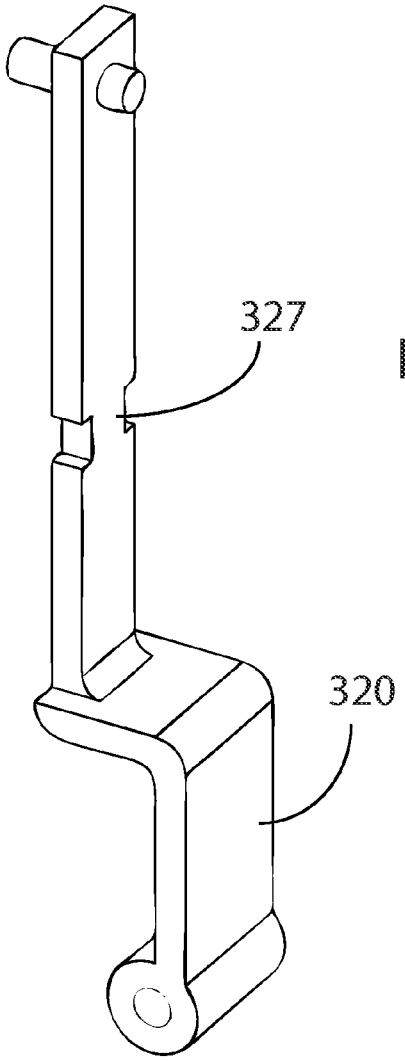
FIG. 19 is a perspective view of the plunger rod of the mechanism used in the handgun of FIG. 11.
Figure 20:
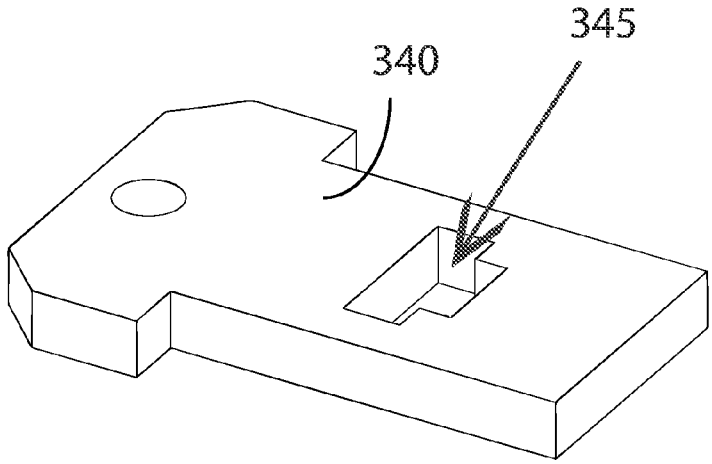
FIG. 20 is a perspective view of the blade of the mechanism used in the handgun of FIG. 11.

One tang embodiment is shown in FIGS. 11-20. This particular embodiment is spring-biased. Tang 310 resides hingedly within the grip 300 of a handgun, firearm, or other device and is actuated by a plunger 320 connected to a push button 330. Plunger 320 is a bent rod pivotably attached to the tang 310 and passing through blade 340 on the back of push button 330. The bend in the rod of the plunger allows for free movement of the tang 310 and plunger 320 relative to each other between the stowed and extended positions. Two notches reside in an upper portion of the plunger 320, forming a narrower portion 327 ("notched portion") of the plunger. A spring 325 resides about plunger 320 between blade 340 and tang 310 while at least one spring 335 biases the push button outward from the grip 300. Blade 340 features a T-shaped aperture 345 (FIG. 20), through which plunger 320 passes. In the stowed position, the notched portion 327 (FIGS. 18, 19) resides in the narrower portion of the T-shaped aperture 345 and spring 325 is compressed (FIG. 15). When actuated, the push button 330 biases the blade 340 such that the notched portion resides in the broader portion of the T-shaped aperture 345, allowing the plunger 320 to slide through the aperture 345 and allows spring 325 to release, forcing the plunger 320 downwards and deploying the tang 310 (FIG. 16). Springs 335 remain compressed as the plunger 320 forces the push button 330 to remain depressed. When the tang 310 is pressed back into the grip 300, the notched portion 327 of the plunger is again positioned in the aperture 345. This then allows the push button 330 to return to its original position and bias the blade 340 forward so that the notched portion 327 again resides in the narrower portion of the T-shaped aperture 345, locking the system in place.

Figure 21:
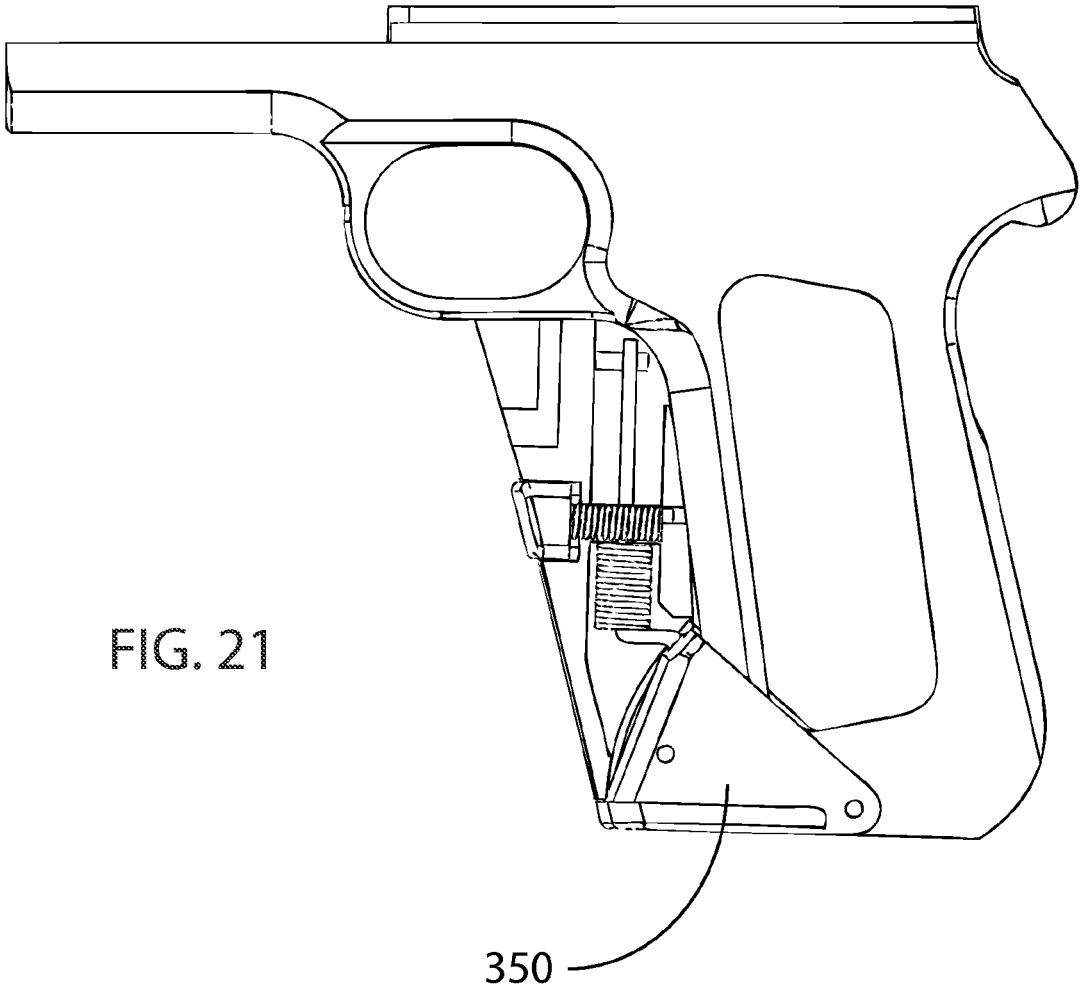
FIG. 21 is a partial section of a magazine fed handgun, utilizing a modified embodiment of the mechanism of the handgun of FIG. 11.
Figure 22:
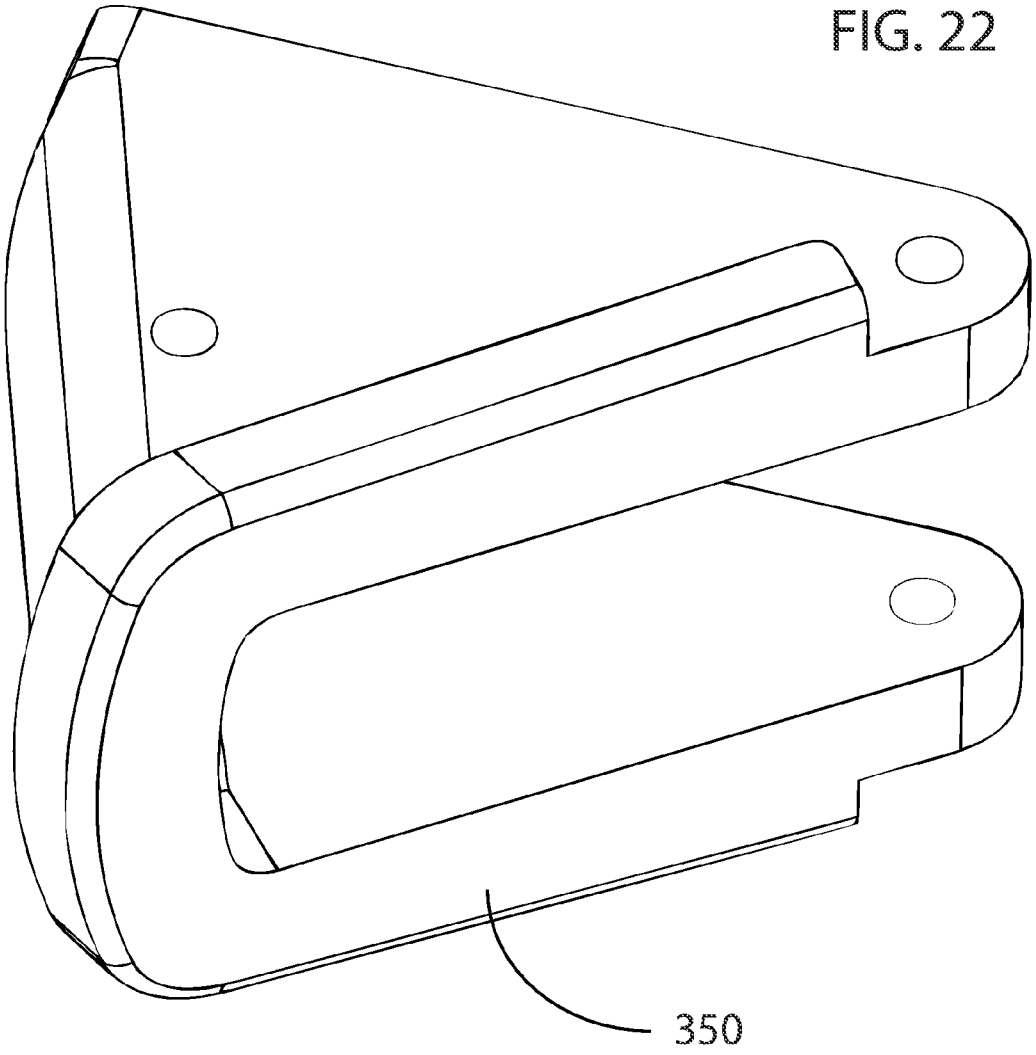
FIG. 22 is a perspective view of one embodiment of an extension grip tang for use with a magazine fed handgun.

Any tang embodiment may be adapted for magazine fed firearms, as this one is shown in FIGS. 21 and 22, simply by providing a hollow tang 350 which fits about the magazine or any solid obstruction in the design of the firearm.

Figure 23:
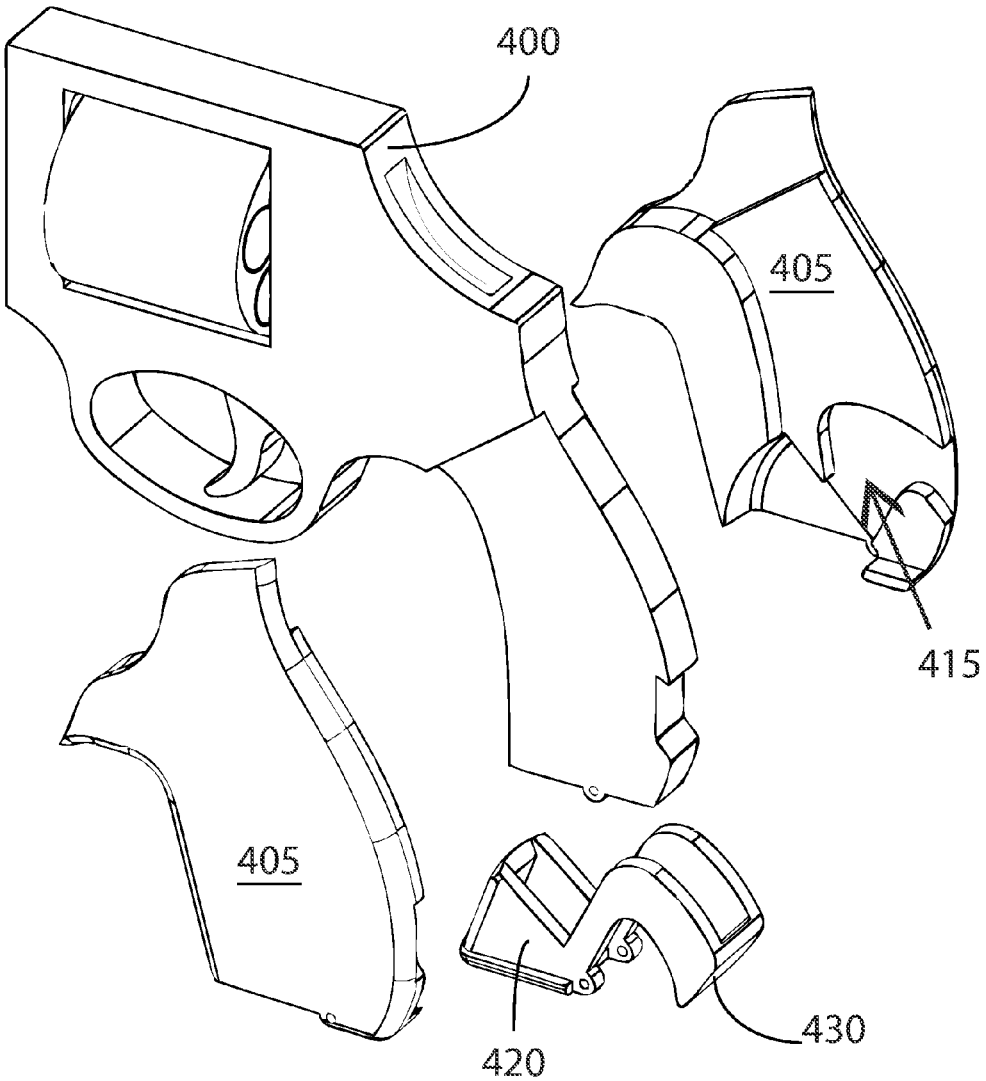
FIG. 23 is an exploded view of a handgun utilizing a second embodiment of the invention.
Figure 24:
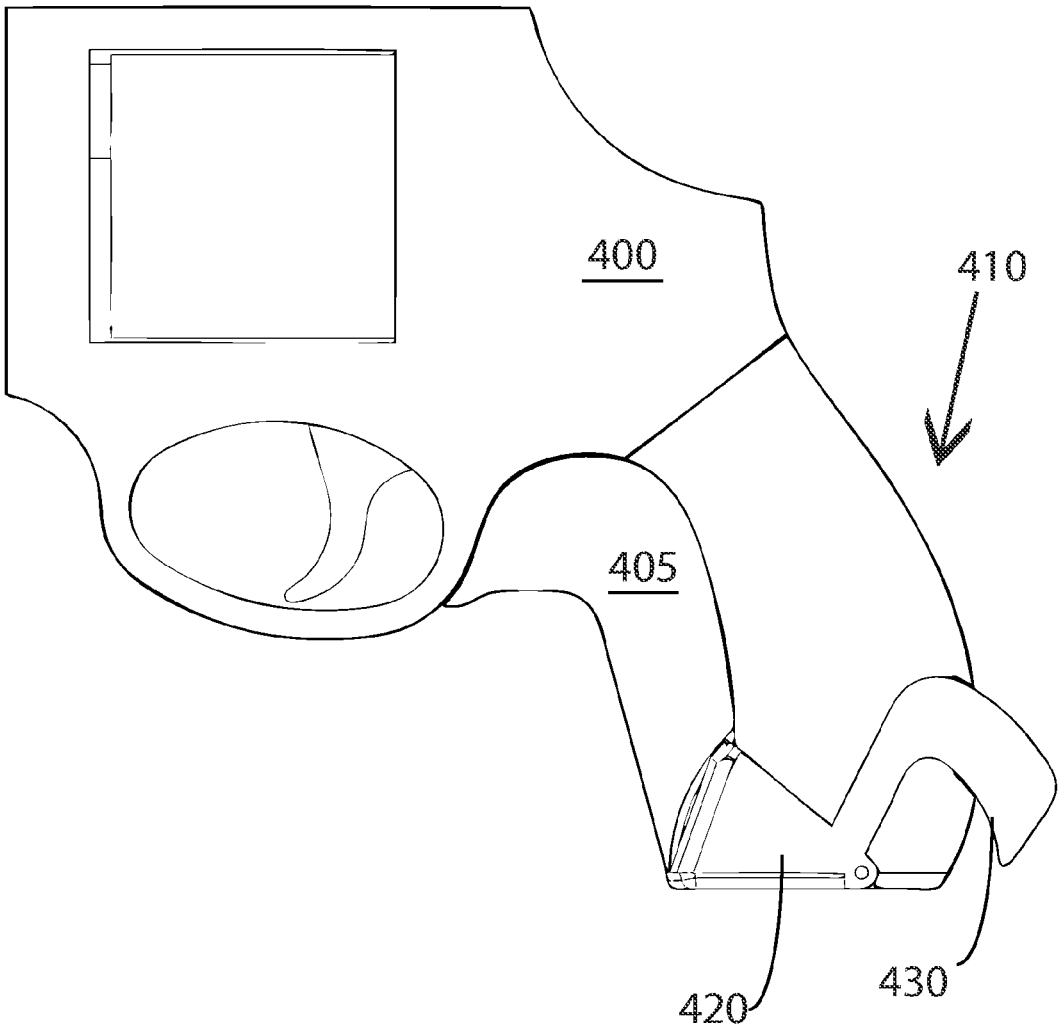
FIG. 24 is a side elevation of the handgun of FIG. 23, with one grip panel removed the grip extension tang in a stowed orientation.
Figure 25:
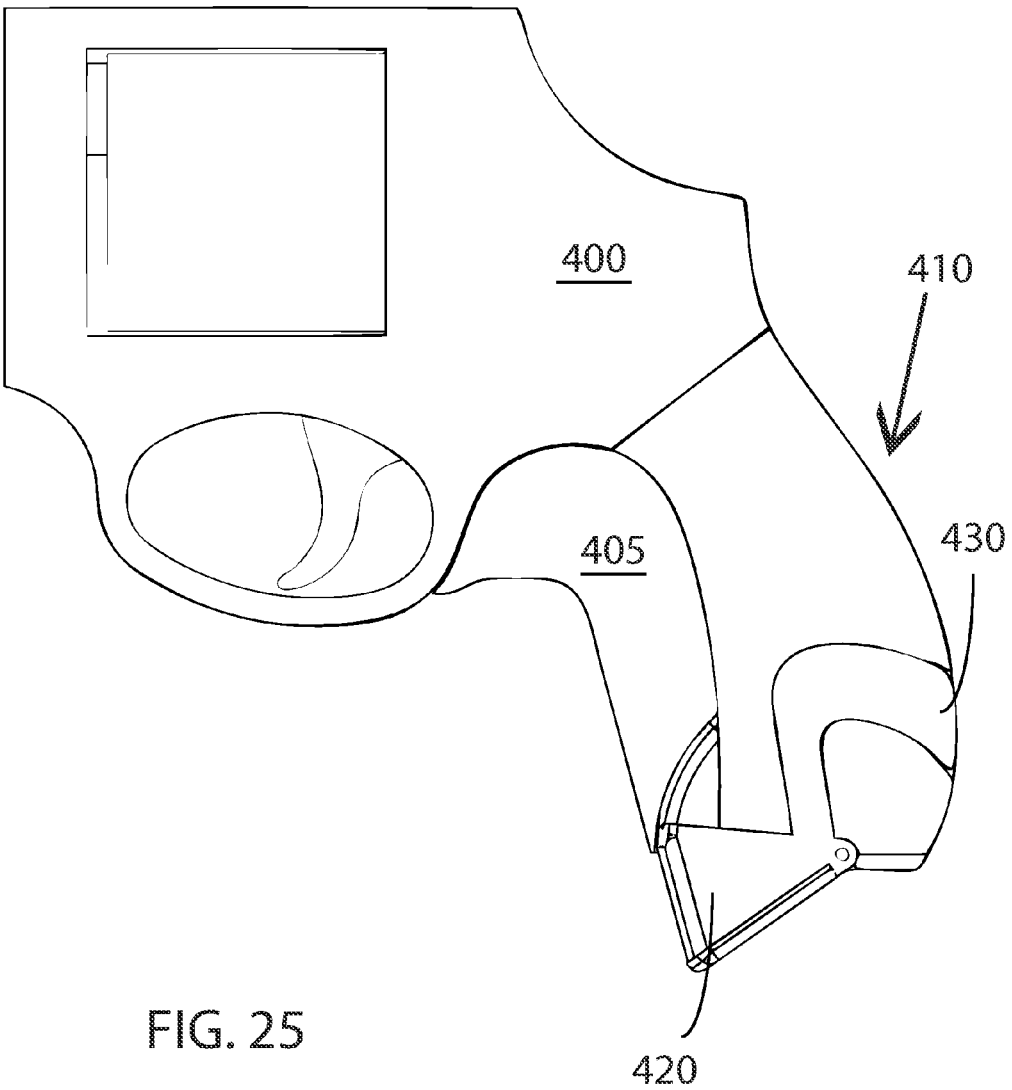
FIG. 25 is a side elevation of the handgun of FIG. 23, with one grip panel removed, the grip extension tang in a deployed orientation.

A second embodiment involves a specially shaped tang 420 with a tang extension 430 that is deployed due to direct pressure on the tang extension 430. This embodiment is shown in FIGS. 23-25. Tang 420 and tang extension 430 are hollow and surround firearm receiver 400. The tang extension 430 extends, when tang 420 stowed, past the back strap of the firearm grip 410. Grip panels 405 for firearm grip 410 each feature an arcuate channel 415 through which the tang extension 430 of the tang travels. The tang extension 430 acts as a push button that is passively depressed when the weapon is brought to bear in the user's hand. When grasping the firearm, the user's hand depresses the tang extension 430 into receiver 400 (with a provided notch), thereby forcing the tang 420 downwards. The tang 420 may be spring-biased so that holstering the firearm, or in any way unhanding it, will automatically retract the tang 420 to a stowed position.

Figure 26:
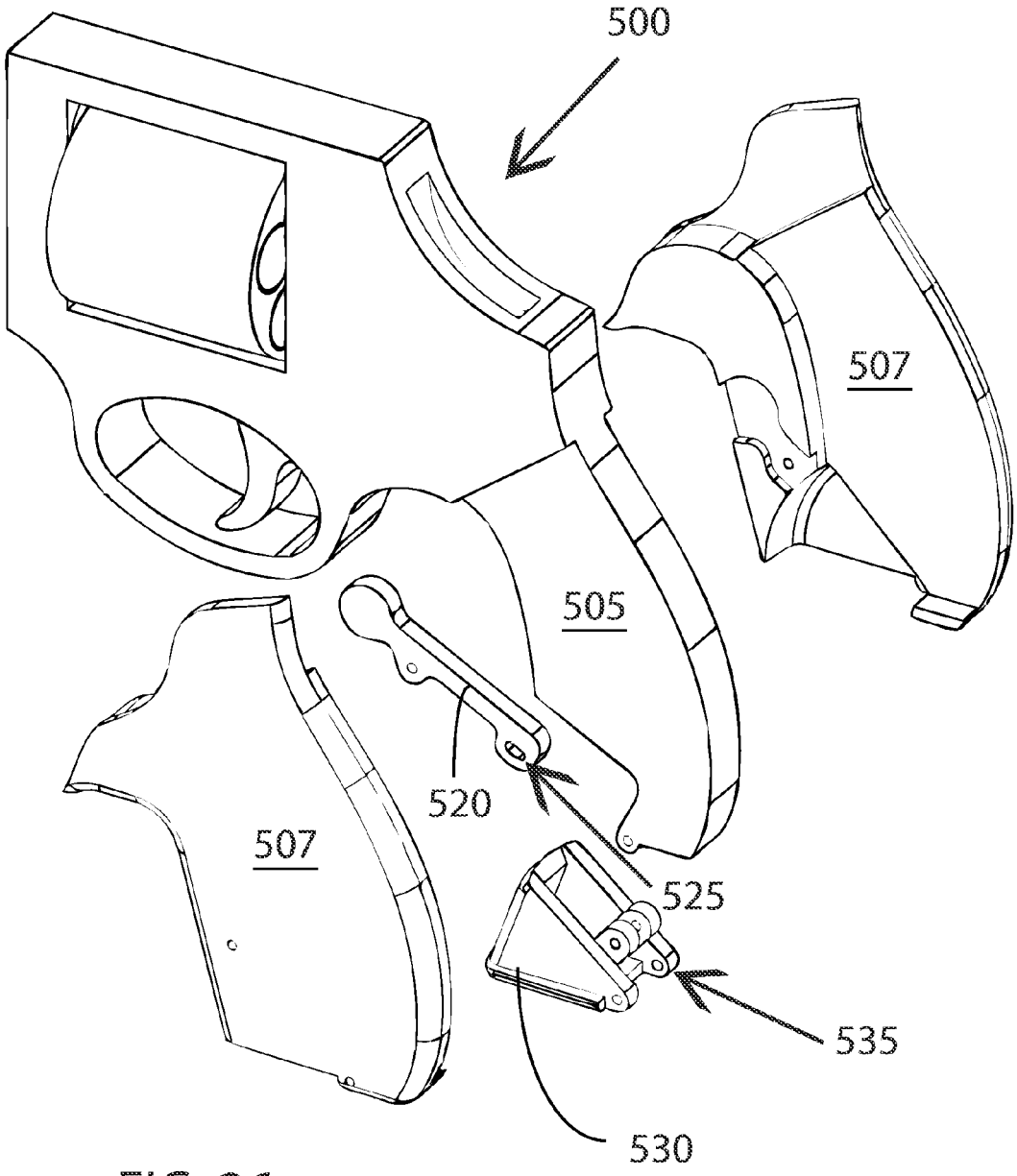
FIG. 26 is an exploded view of a handgun utilizing a third embodiment of the invention.
Figure 27:
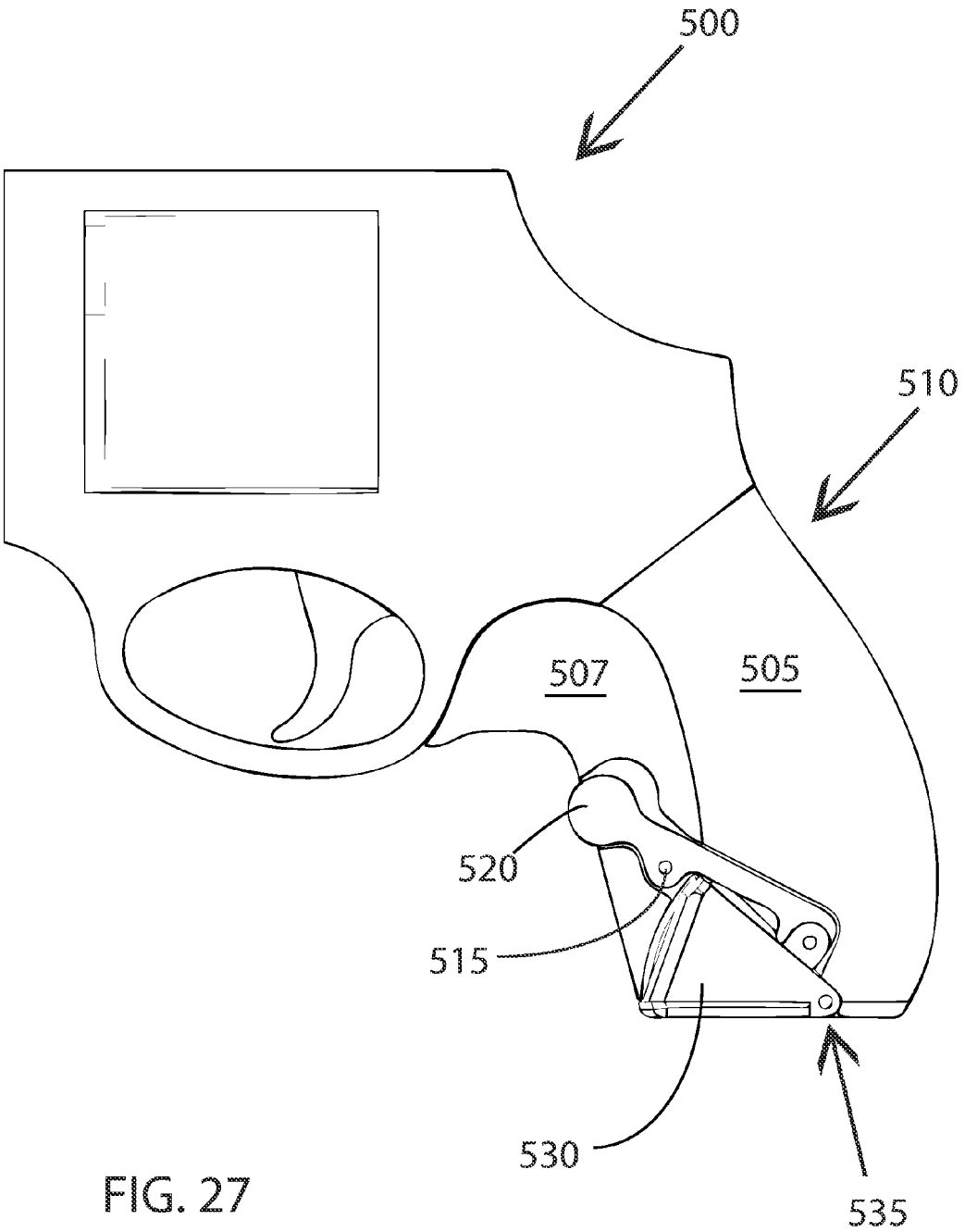
FIG. 27 is a side elevation of the handgun of FIG. 26, with one grip panel removed the grip extension tang in a stowed orientation.
Figure 28:
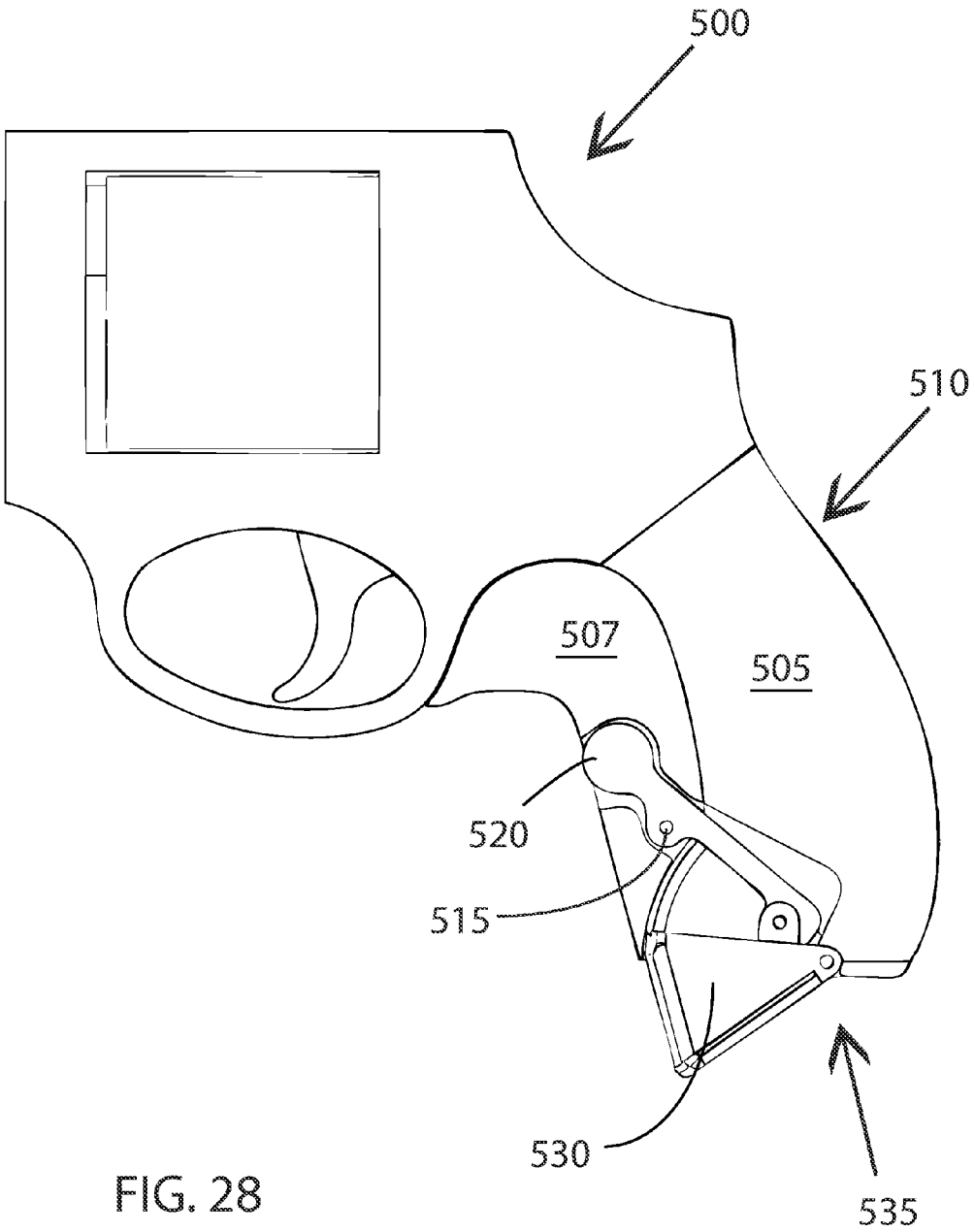
FIG. 28 is a side elevation of the handgun of FIG. 26, with one grip panel removed, the grip extension tang in a deployed orientation.

As shown in FIGS. 26-28, a third embodiment is also passively deployed, but utilizes a lever 520 so that pressure from the user grasping the firearm is indirectly applied from the user's hands to the extendible tang 530. Lever 520 protrudes from the front of grip 510 and is pivotally mounted within the grip 510, between the grip panels 507 and receiver frame 505. The location of this protruding end of the lever 520 is such that a user will automatically actuate the lever 520 when gripping the firearm 500. Grip panels 507 may provide the fulcrum for the lever and possibly channels for the tang 530. The other end of the lever is connected to the tang 530, close to its pivot point 535 on the receiver frame 505 of the firearm 500, or, alternately, on the grip panels 507. Because of its location on the tang 530, small movements of the lever 520 create arcuately significant movement of the tang 530, such that the tang 530 is fully exposed when the lever 520 is actuated by the user. The lever 520 and/or tang 530 may be spring biased to have the tang 530 remain in a stowed orientation when the lever is not actuated, thus allowing for automatic stowage when the firearm 500 is released. For optimum operation, this embodiment features an oblong slot 525 in the lever 520 where the lever 520 and tang 530 meet. This provides a certain amount of play between the components which aids in the linkage of said components. This play may also be achieved by placing the slot 525 on the tang 530 and a pivot point on the lever 520.

Figure 29:
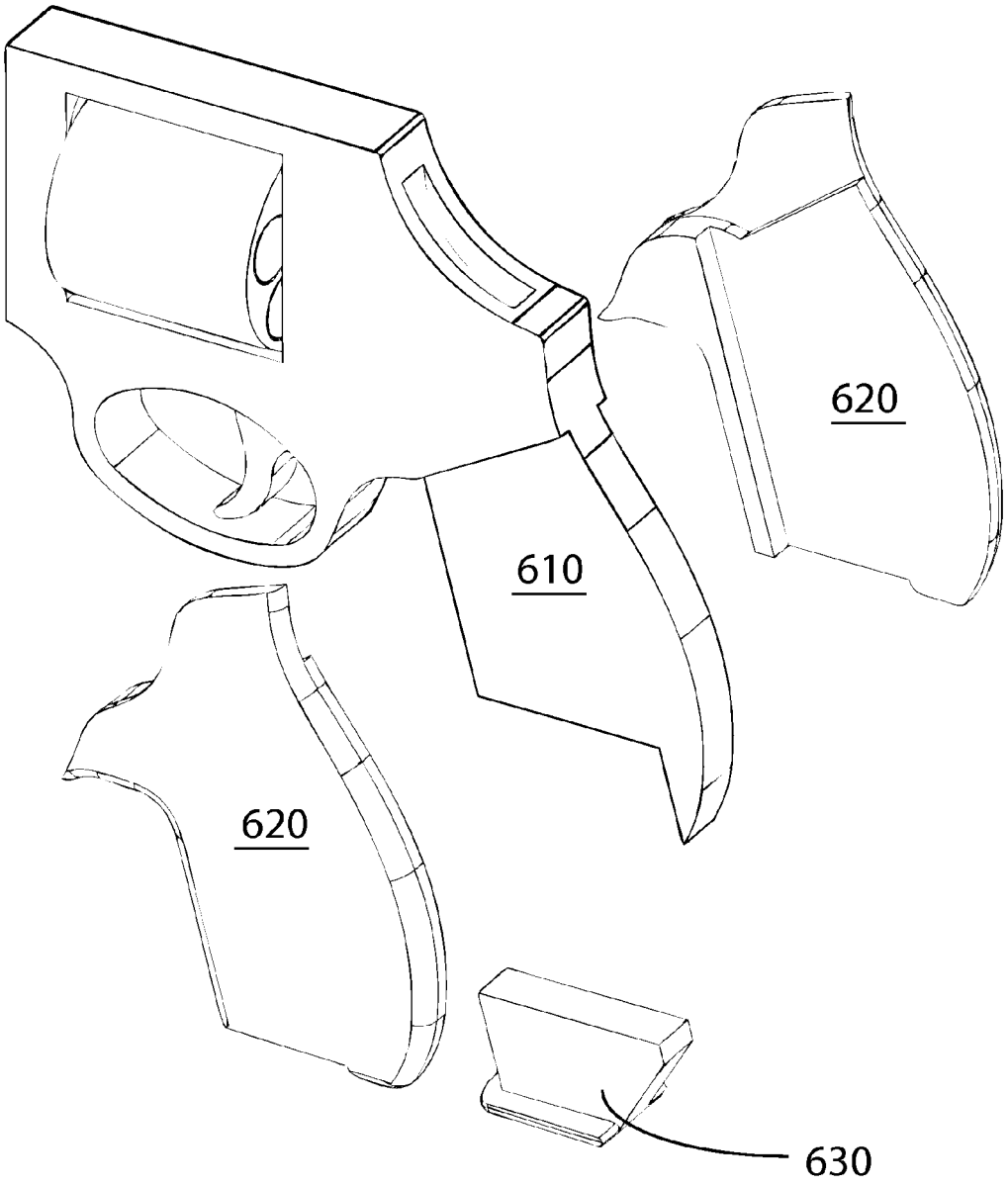
FIG. 29 is an exploded view of a handgun utilizing a fourth embodiment of the invention.
Figure 30:
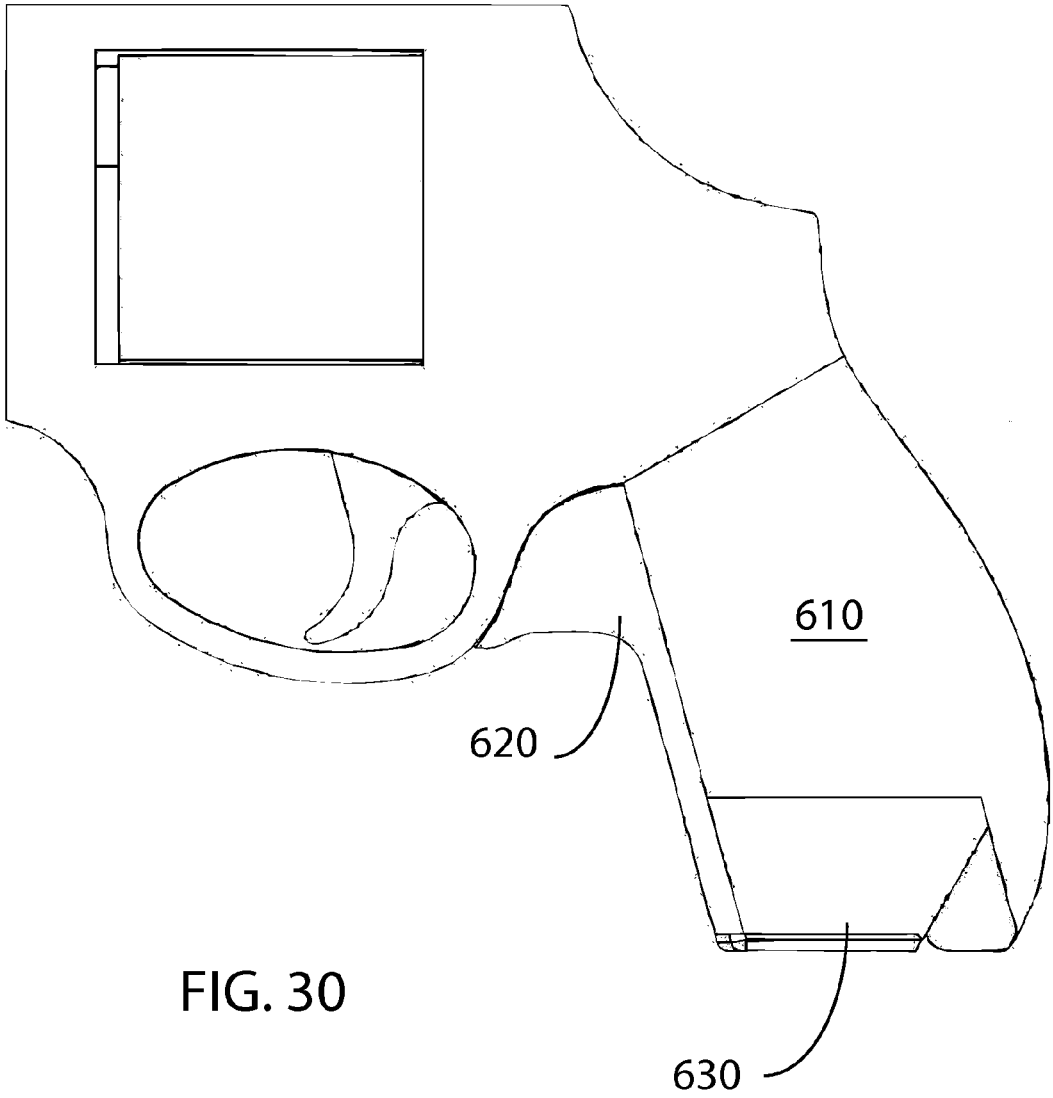
FIG. 30 is a side elevation of the handgun of FIG. 29, with one grip panel removed the grip extension tang in a stowed orientation.
Figure 31:
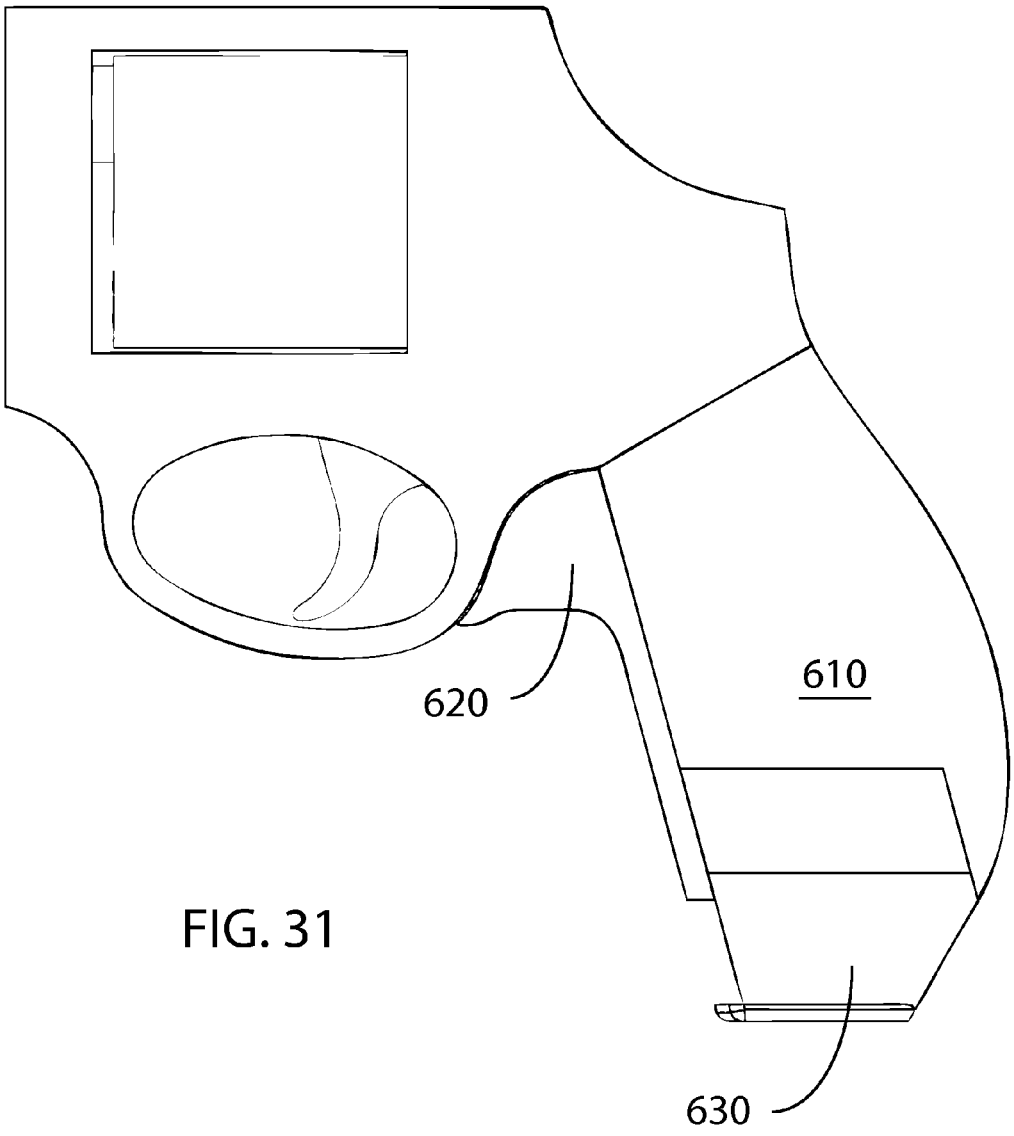
FIG. 31 is a side elevation of the handgun of FIG. 29, with one grip panel removed, the grip extension tang in a deployed orientation.

A fourth embodiment of the invention is shown in FIGS. 29-31 in which the tang 630 is held in a sliding relationship between grip panels 620 and frame 610. A notch is provided in frame 610 to accommodate the tang 630 and this notch may be cut out of existing frames or the frame may be manufactured with this invention in mind. The tang may or may not be spring biased and may be utilized with any of the latching and/or deployment mechanisms described in the previous three embodiments with little alteration. It is to be readily understood that the angular motion of the tang described in the previous embodiment may also be translated into a linear motion without departing from the scope of this invention. As such, the depicted fourth embodiment, in actuality, represents a variation on the previous three and may utilize any of the features previously described.

The embodiments indicated within this specification may be utilized on any existing firearm with minimal alteration of the firearm. In some cases, the receiver frame may need to be cut in order to accommodate the mechanisms described herein. Grip panels are easily designed to incorporate the mechanisms described. Tangs and other components may be mounted either upon the firearm frame or grip panels. Firearms may also be developed and designed with the mechanisms described herein specifically in mind such that grip panels and receiver frames may be manufactured intending for the use of the present invention therewith. It is easily considered that the spring pressure may be used to either deploy or stow the tang and embodiments described herein may be altered within the scope of this invention such that the tang is automatically deployed when unholstered and stowed when holstered.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An extendable grip tang for a firearm, the extendable grip tang comprising:

a. a tang body concealable, in a stowed orientation, within a cavity in a firearm grip and being pivotably mounted proximate an edge of said cavity;

b. means for deploying said tang body from the stowed orientation, the tang body deploying radially from within the cavity of the firearm grip by pivoting about a stationary hinge.

2. An extendable grip tang for a firearm, the extendable grip tang comprising:

a. a tang body concealable, in a stowed orientation, within a cavity in a firearm grip;

b. s pring providing force to basis the tang body into a deployed orientation; and c. a latching mechanism capable of securing the tang body in the stowed orientation and selectably releasing the tang for deployment, the latching mechanism further comprising:

i. a push button, located on the firearm grip;

ii. a blade residing behind the push button, said blade having a T-shaped orifice;

iii. at least one spring providing an outward bias to the push button;

iv. a plunger rod residing in a perpendicular relationship with the blade and located within the T-shaped orifice, the plunger rod also pivotably connected to the tang; and v. a deployment spring residing about the plunger rod between the blade and the tang;

wherein the plunger rod resides in a narrow portion of the T-shaped orifice when the extendable tang is stowed and the deployment spring stores energy for which to deploy the tang when released and, when the push button is actuated, the blade releases the plunger rod into a broader portion of the T-shaped orifice, releasing the deployment spring and associated extension tang.

3. The extendable grip tang of claim 2, the plunger rod being notched, such that a portion of it is narrower than a remainder of the plunger rod, the narrower portion residing within the narrower portion of the T-shaped orifice when the tang extension is stowed.

4. The extendable grip tang of claim 2, the plunger rod being bent in a manner to comport with the tang body.

5. The extendible grip tang of claim 2, the tang body being hollow, in a manner to accommodate a firearm magazine.

6. The extendible grip tang of claim 2, the deployment spring being the spring providing the spring force to the tang body.

7. The extendable grip tang of claim 1, the extendable grip tang further comprising:

a. a spring providing force to bias the tang body into a stowed orientation; and b. a pressure mechanism, capable of counteracting the spring force and deploying the tang body.

8. The extendable grip tang of claim 7, the tang body further comprising an extension, extending outside of the firearm grip and serving as the pressure mechanism, such that, when the firearm grip is grasped, pressure will be applied to the extension and associated tang body, forcing the tang body to pivot outwards of the firearm grip against spring pressure.

9. The extendable grip tang of claim 1, the extendable grip tang further comprising a lever, pivotably mounted within the firearm grip and having a linkage with tang body said lever further comprising an actuation end projecting out from the firearm grip in a manner to be automatically actuated when the firearm is grasped and said actuation directs the lever to pivot the tang body out from the stowed orientation into a deployed orientation.

10. The extendable grip tang of claim 9, the tang body being spring biased into a stowed position.

11. The extendable grip tang of claim 9, the linkage being relatively close to a pivot point between the tang body and the firearm such that small, arcuate displacement of the tang body proximate the pivot point causes a proportional displacement of the tang body based on the small arcuate displacement.

* * * * *